US006112928A

United States Patent [19]

Black et al.

[11] Patent Number: 6,112,928

[45] Date of Patent: Sep. 5, 2000

[54] FOLDABLE SELF-STANDING CONTAINER WITH METHOD OF MANUFACTURE AND BULK DISPENSER

[75] Inventors: William S. Black, Provo; Ra'ed Al'Zubi, Murray; A. Cameron Sevy, Provo, all of Utah

[73] Assignee: Box Ease International, Provo, Utah

[21] Appl. No.: 09/003,796

[22] Filed: Jan. 7, 1998

Related U.S. Application Data

[60] Continuation-in-part of application No. 08/721,047, Sep. 26, 1996, Pat. No. 5,735,423, which is a division of application No. 08/508,817, Sep. 28, 1995, abandoned

[60] Provisional application No. 60/034,187, Jan. 7, 1997.

[51] Int. Cl.[7] ..... B65D 6/18

[52] U.S. Cl. ..... 220/6; 220/23.86; 220/62; 383/63

[58] Field of Search ..... 220/6, 7, 666, 220/495.03, 495.06, 23.83, 23.86, 23.87, 62, 62.1; 383/65, 63; 229/117.05

[56] References Cited

U.S. PATENT DOCUMENTS

| | | | |
|---|---|---|---|
| 632,451 | 9/1899 | Drawbaugh . | |
| 1,111,619 | 9/1914 | Schrader . | |
| 2,257,340 | 9/1941 | Jacobsen | 206/494 |
| 2,361,877 | 10/1944 | Schell | 229/14 |
| 2,409,489 | 10/1946 | Hurt | 150/3 |
| 2,950,029 | 8/1960 | Winstead | 222/143 |
| 3,249,286 | 5/1966 | Palmer | 229/55 |
| 3,286,879 | 11/1966 | Philippon | 221/36 |
| 3,434,589 | 3/1969 | Valtri et al. | 206/46 |
| 3,576,243 | 4/1971 | Trunick | 221/63 |
| 3,676,159 | 7/1972 | Fallowfield | 99/174 |
| 3,679,096 | 7/1972 | Musser | 221/56 |
| 3,939,887 | 2/1976 | Scarnato | 150/0.5 |
| 4,005,801 | 2/1977 | Musser | 221/56 |
| 4,041,851 | 8/1977 | Jentsch | 93/35 |
| 4,210,230 | 7/1980 | Weiner | 190/43 |
| 4,231,490 | 11/1980 | Boudreault | 220/354 |
| 4,674,655 | 6/1987 | Lofgrer et al. | 222/48 |
| 4,792,086 | 12/1988 | Chen | 229/117 |
| 4,837,849 | 6/1989 | Erickson et al. | 383/104 |
| 4,838,444 | 6/1989 | Bitel | 220/4 |
| 4,848,579 | 7/1989 | Bames et al. | 206/508 |
| 4,875,576 | 10/1989 | Torgrimson et al. | 206/219 |
| 4,896,775 | 1/1990 | Boeckmann et al. | 206/557 |
| 4,949,527 | 8/1990 | Boeckmann et al. | 53/412 |
| 5,058,761 | 10/1991 | Williams | 220/306 |
| 5,174,458 | 12/1992 | Segati | 215/383 |
| 5,182,895 | 2/1993 | Lugo | 53/469 |
| 5,209,392 | 5/1993 | Anatro | 229/117.01 |
| 5,375,930 | 12/1994 | Tani | 383/206 |
| 5,429,260 | 7/1995 | Vollers | 220/7 |
| 5,632,406 | 5/1997 | Robbins, III | 220/666 |
| 5,725,310 | 3/1998 | Kruczko | 383/11 |
| 5,735,423 | 4/1998 | Black | 220/23.83 |

FOREIGN PATENT DOCUMENTS

| | | | |
|---|---|---|---|
| 0423892 | 4/1991 | European Pat. Off. | 18/5 |
| 2204015 | 11/1988 | United Kingdom | 16/33 |
| 2260894 | 5/1993 | United Kingdom | 66/383 |

*Primary Examiner*—Stephen Castellano
*Attorney, Agent, or Firm*—Brian C. Kunzler

[57] ABSTRACT

A foldable, self-standing container is disclosed which can be formed of plastic, paper, metal, or other materials and can be sealed with an integral top. The container is formed with unique fold lines in two side sections and the bottom section. When folded, the self-standing container lies flat and can be instantly opened into the upright, self-standing position by exerting opposing forces on two exposed sides of the container. When formed of metal, the fold lines are made in the form of joints, preferably connected with a resilient, liquid-tight, heat-proof sealant material. Also disclosed is an efficient method for bulk dispensing of the containers as well as a method of making and folding the containers, including an inventive box folding device. A method for permanently forming a curvature in a plastic bead and groove type zipper-type closure device is also provided in order to continuously extend the zipper-type closure device around a plurality of the sides of the foldable, self-standing container.

19 Claims, 14 Drawing Sheets

FOLDABLE SELF-STANDING CONTAINER WITH METHOD OF MANUFACTURE AND BULK DISPENSER

RELATED APPLICATIONS

The present invention claims priority of and is a continuation-in-part of U.S. patent application Ser. No. 08/721,047 which was filed with the U.S. Patent and Trademark Office Sep. 26, 1996, now U.S. Pat. No. 5,735,423, which is a divisional of Ser. No. 08/508,817, filed Sep. 2, 1995, now abandoned and of Provisional Patent Application No. 60/034,189, which was filed with the U.S. Patent and Trademark Office on Jan. 7, 1997.

BACKGROUND OF THE INVENTION

1. The Field of the Invention

The present invention relates to self-standing storage containers. More particularly, the present invention is directed to a container capable of being folded into a substantially flat position in which it occupies a minimum of space for efficient storage and distribution, and from which it can be quickly transformed to an upright, self-standing position for use in storing food or other items.

2. Prior State of the Art

Packaging products are indispensable to our present consumer-oriented society. Packaging products free people from mundane tasks such as daily shopping for fresh food. They also make consumer goods more conveniently accessible and help lower the cost of these goods. Many of the items and much of the food consumed today are perishable and require containment against contamination from and leakage into the outside environment. Virtually all products sold to consumers necessitate convenient methods of bundling, transporting, storing, and displaying. As a consequence, the majority of food and other items presently consumed come packaged in one form or another.

One of the primary objects of our increasingly service oriented economy is providing convenience to the consumer. In the packaging industry this translates to providing effective, inexpensive, and flexible packaging products. Some packaging products that currently offer a high level of convenience include home packaging and repackaging products such as disposable plastic storage bags and hard sided plastic containers. Even these convenience oriented products are in need of improvement, however, as will be discussed.

Plastic storage bags are inexpensive, air-tight, and are often used for applications such as storing and preserving frozen foods, sandwiches, and leftovers. They provide a great advantage in that they are disposable. They also take up a minimum of storage space when empty. One convenient addition to plastic storage bags is the zipper-type closure device along the opening or mouth of the bag. These zipper-type bags provide a high degree of the convenience that modern day consumers demand, but they do have certain disadvantages. For instance, zipper-type bags are difficult to stack as they are incapable of retaining their shape when filled, and they are incapable of standing on their own. They cannot be placed on a surface with their contents exposed, making them inadequate for microwave cooking, another convenience desired by modern day consumers. They are also not well suited for containing liquid materials. Additionally, filling plastic bags is inconvenient and requires pulling the bag out of a box, opening the bag, then holding the sides of the bag open while filling it. This process can be time consuming, especially when used for multiple filling operations.

Hard sided containers stand by themselves, can be reused, and are easy to fill. The contents can be stirred, heated, and otherwise accessed with the top off. Nevertheless, hard sided containers are quite bulky and take up a large amount of storage space, especially when the containers are of large volume. In addition, the lids to hard sided containers are often lost or misplaced, making proper or complete use of the hard sided containers difficult.

Another example of packaging upon which consumers rely for convenience is the grocery bag. Paper grocery bags are self-standing and much easier to fill than the plastic bags discussed above, but they are not sealable and cannot be used to contain perishable items over long periods of time. Furthermore, when opening such bags, one is required to undertake the time consuming procedure of removing a bag from a stack, opening the bag by holding it apart with one hand while thrusting the other hand into the bag, or gripping an edge portion thereof, followed by quickly moving the bag through the air causing air to enter the bag for the opening thereof. Plastic bags have also been used as grocery bags, and are desirable in that they are less expensive to produce. The main disadvantage of plastic bags is that they generally cannot maintain a standing position on their own. They must be opened and then placed on a rack in order to be easily filled. The opening procedures of both plastic and paper grocery bags are quite time consuming and require wasteful motions. In a retail store or convenience store where customer throughput is important, such time consuming operations are objectionable.

Consumers have shown a preference for self-standing reclosable plastic bags because of the convenience of filling them, of storing highly fluid liquids in them, and of microwave heating foods directly in the bag. The art has made attempts at creating such bags, as evidenced by U.S. Pat. No. 4,837,849 to Erickson et al., U.S. Pat. No. 4,041,851 to Jentsh, U.S. Pat. No. 5,375,930 to Tani, U.S. Pat. No. 3,249,286 to Palmer, and U.S. Pat. No. 4,896,775 to Boeckmann et al. Each of these attempts, however, still exhibit several drawbacks. For instance, most do not stand easily when empty and are difficult to maintain open when filling and emptying the bags. Furthermore, none of the bags fold easily, whereby the bag may be laid flat and then opened quickly to an upright, self-standing position with a minimum of effort. Additionally, none of the bags are provided with an accompanying bulk distributing method whereby the bags would be suitable for high volume filling operations.

Other needs also exist for containers that are convenient and functional. For instance, containers are needed that can be easily filled, transported, and minimized in size when empty. As an example, backpackers have a need for containers and cookware that are light and occupy a minimum of space. A metal pan or pot or rubberized container that folds flat would be highly useful where space is at a premium, such as in backpacking.

Containers might also be improved upon for bulk fluid storage. In one application, chemical and pharmaceutical companies ship large amounts of fluids in bulk and could reuse containers if they could be easily shipped and stored when empty. A self-standing foldable container made of plastic and having a sealed top would be useful for such bulk liquid storage, especially if the empty containers could be stored or transported using a minimum of space.

Containers might also be improved upon for storage or distribution of clothing, food items, or other supplies. In one application, department stores could replace their rectangular, shallow cardboard boxes that require time consuming assembly with a cardboard box dispenser holding folding boxes that instantaneously open for filling as they are removed from the dispenser. In fact, all present containers, including clothing boxes, food crates, milk cartons, and the like, would benefit from a design whereby the container is distributed in a flat position occupying a minimum of space and with which the container is easily opened into an upright self-standing position with minimal time and effort. Such a container would be even more useful if it could be dispensed in bulk in a compact dispenser from which the container and others like it were instantly released into an upright, self-standing position by merely releasing the container from the dispenser. This would make the container easier to store and ship when empty and reduce the time spent in assembling, opening, and filling the container.

From the above discussion, it is apparent that a need exists in the art for a self-standing container which is easily folded to occupy a minimum of space, which can be easily opened, and which has the flexibility to meet each of the packaging needs outlined above. Additionally, there is a need for such a container which can also be dispensed conveniently in bulk and manufactured using a process that is efficient and inexpensive.

SUMMARY OF THE INVENTION

The present invention seeks to resolve the above and other problems which have been experienced in the art. More particularly, the present invention constitutes an advancement in the art by providing a foldable, self-standing container, and a system for bulk distribution of the container, as well as a method for manufacturing the container that achieves each of the objects listed below.

The present invention provides a container that is self-standing and that can be rendered airtight for use with perishable items.

The present invention also provides a container that is foldable into a flat, space saving position.

The present invention likewise provides a container that is easily opened from a folded position to a standing position merely by exerting an outward pressure on two opposing sides of the container.

Further, the present invention provides a container that can be easily filled without the need to hold the container open or affix the container to a rack, and which will support its contents without being covered, such that it is suitable for microwave heating of its contents.

The present invention provides a container that has a shape conducive to efficient use of shelf space and easier stacking and handling.

In addition, the present invention provides a container that can be provided with a zipper-type lid, making the container resealable.

The present invention also provides a container that can be dispensed from a bulk dispenser where the container occupies a minimum of space, and from which the container can be easily and quickly dispensed and concurrently opened into a self-standing position.

Further, the present invention provides a method of manufacturing a container whereby the unique folds of the container can be easily and inexpensively provided and whereby the container can be efficiently folded into a folded position such that it may be inexpensively produced and shipped in high volume and density.

The present invention also provides a foldable, self-standing container that can be made of varying materials, including metals and films thereof for cooking and camp use.

The present invention provides a foldable, self-standing container that is fully enclosed for storing and transporting liquid materials.

In accordance with the invention as embodied and described herein, the present invention comprises a foldable, self-standing container. The self-standing container is configured into two positions, an upright, self-standing position, and a collapsed, folded position whereby the container lies flat and is easily transformed into the self-standing position by grasping at least two exposed sides of the container and exerting an outward pressure on the two exposed sides.

The self-standing container of the present invention comprises four side sections and a bottom section. The bottom section is preferably integrally attached to each side section. The side sections are folded upwards from the bottom section and then connected together at the edges to form a box shape with four corners, such as a cube or hexahedron. In order to provide a means for adapting the container into both a folded position and a separate upright, self-standing position, the bottom section is provided with a horizontal fold line through the center thereof and extending between vertical fold lines located at the center of each of the right and left side sections. Four diagonal fold lines stem from the horizontal fold line at 45° angles, one extending to each of the four corners.

The self-standing container is transformed into the folded position by raising the center of the bottom section upward and folding both the right and left side sections in two separate sections by pushing the vertical fold lines inward toward the interior of the container. The diagonal fold lines of the bottom section are thereby raised upward. When the bottom of the container is square, the horizontal fold line in the bottom section hinges in the center, thus dividing the horizontal fold line into two equal segments that fold over and are drawn into the interior to become parallel and adjacent to each other. The bottom section forms six overlapping segments comprising triangles, or trapezoids and triangles if the bottom section is rectangular, folded accordion style one on top of another. A front and a rear side section remain exposed with the remainder of the container folded flat between the front and side sections. The container is thus reduced to a folded position that, when the container is made with the preferred dimensions, has substantially the same surface area as one or both of the front and rear side sections. Pulling the front and rear side sections apart will instantaneously open the container into the upright, self-standing position.

The self-standing container may be provided with an integral top section having fold lines identical to and in the mirror image of the bottom section, and with a spout for containing liquids. The self-standing container may alternatively be provided with a folding or zipper-type lid, or it may be left open. The self-standing container can be made of plastic, paper, metal, metal foils, rubber-like materials, or any other suitable material. If made of a rigid material, the fold lines are preferably formed with thin perforations, serrations, or creases. A rigid self-standing container can also be formed from discrete sections held together and sealed with tape or hinges at the fold lines. The tape will preferably be both liquid-tight and heat resistant.

In one embodiment, two self-standing containers, with the opening of one just slightly smaller than the opening of the other, are used to fully enclose the contents of the first self-standing container by placing the second self-standing container over the top of the first. In this manner, suitable clothing or food boxes are formed. When so doing, the first and second self-standing container are preferably made of cardboard or paper board and are distributed and stored when empty with both of the first and second containers in the folded position.

In a further, closely related embodiment, a foldable lid can be integrally attached to the rear side section of the container and provided with skirt sections on the three unattached sides. The foldable lid is also provided with fold lines formed in the mirror image of those of the bottom section. Thus, when reducing the self-standing container to the folded position, the foldable lid would be folded flat and would then be folded down against the rear side section of the self-standing container. The self-standing container would thus retain the surface area when in the folded position of one or both of the front and rear side sections.

A method for dispensing the containers in bulk is also provided, and includes a bulk dispenser having six sides and an opening in at least one of the six sides. The self-standing containers are laid flat in the folded position and are stacked inside the bulk dispenser. Preferably, each self-standing container has a tab on its lid which extends through a notch in one side of the opening of the bulk dispenser. Pulling on the tab extending through the notch draws the container through the opening of the bulk dispenser and the container then emerges therefrom substantially in the open, upright, and self-standing position.

A method of manufacture is also part of the present invention and comprises stamping a sheet of the desired material to form four sides and a bottom as well as to crease or serrate the initial folds between the sides, the bottom, and the lid. The folds, which may be accomplished by conventional techniques known to those of skill in the converting arts, enable the self-standing container to be collapsed into the folded position, and are preferably stamped or otherwise formed at this time. The sides are then folded upward and the corners are sealed together. The container can then be inserted into a box folding device that is comprised of four side sections and a bottom section. The side sections and the bottom section have folds identical to those previously described.

The box folding device is preferably formed of a rigid material such as metal, with the fold lines being replaced by joints or hinges. The box folding device is folded flat in a manner similar to that described for the self-standing container with the self-standing container held in the folding box device. This concurrently folds the self-standing container into the folded position. The self-standing container is then removed from the box folding device in the folded position and can be packaged together with other self-standing containers, inserted into the bulk dispensing container, or otherwise distributed to consumers. Strategically placed cuts, gaps, or designed holes in the corners and bottom center and sides of the box folding device reduce the friction between the box folding device and the inserted self-standing container, making removal of the folded container from the folding device much smoother.

A zipper-type closure is provided that preferably extends around three sides of the self-standing container. In one embodiment, the zipper-type closure device comprises a bead and groove closure device. The bead is connected at an edge of a first three-sided insert and the groove is connected at the edge of a second three-sided insert. One of the three-sided inserts is bonded or otherwise attached to the lid, extending outward in a plane with the lid, and the other of the three-sided inserts is attached to the tops of three sides of the self-standing container extending outward perpendicular to each of the three sides. Preferably, the bead and groove are each formed of an integral piece of plastic.

In order to permanently form the curvatures in the bead and groove closure device that are necessary to forming the integral bead and groove which extend around the three sides of the three-sided inserts, a method of curving the bead and groove is provided. The method comprises providing a template having thereon the selected curvatures with which the bead and groove are to be shaped. The bead and groove are fastened together and pressed against the template as heat is applied to portions of the bead and groove that are to receive the selected curvature. The bead and groove are preferably brought into contact with the heated portions of the template gradually and for a period of time sufficient to bring the selected portions up to a temperature at which plasticity occurs, but at which melting does not. Thereafter, the bead and groove are cooled below the temperature at which plasticity occurs, and the bead and groove are removed from the template.

The bead and groove are thus permanently given a selected curvature suitable for forming the three-sided inserts, and the ability to form an air-tight seal between the bead and groove portions of the bead and groove closure device is maintained.

Under the present invention, an easily foldable container that is quickly opened into the self-standing position is provided. The container is not required to be held open when filling, and can be microwaved with the contents exposed to the outside ambient. The container can be sealable, is compact, and is of a shape that is easily stacked, stored, and transported. The container is readily dispensed using the inventive dispensing method and is easily manufactured using the inventive method of manufacture.

The manner of making and using the present invention will become more fully apparent from the following description and appended claims, or may be learned by the practice of the invention as set forth hereinafter.

BRIEF DESCRIPTION OF THE DRAWINGS

In order to further clarify the invention, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 3:
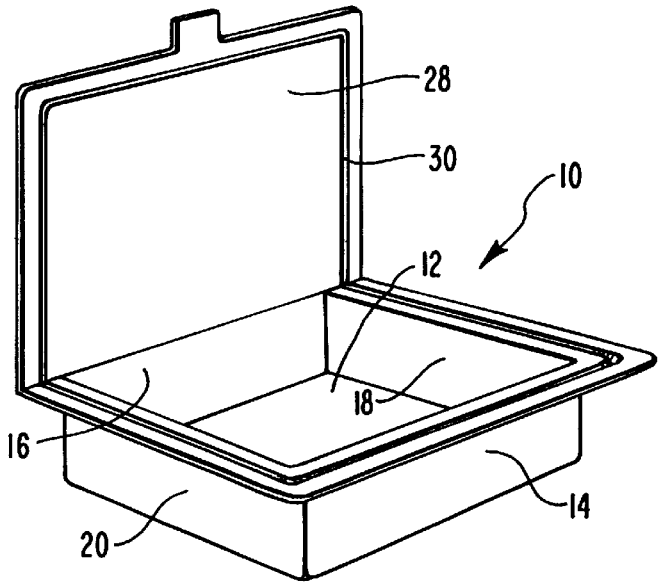
FIG. 3 is a perspective view of a self-standing container of the present invention in the upright, self-standing position after fastening the corners of the blank seen in FIG. 2.

The present invention comprises a self-standing container capable of being adapted into a folded position and thereafter being easily and instantaneously opened to an upright and self-standing position. Shown in FIG. 3 is a self-standing container of the present invention in the self-standing position, generally indicated at 10. Self-standing container 10 comprises a bottom section 12 and four side sections 14, 16, 18, and 20, each extending from bottom section 12. Side sections 14, 16, 18, and 20 are preferably sealably bonded to one another at the edges, thereby making self-standing container 10 airtight and liquid-tight. Side sections 14, 16, 18, and 20 are square or rectangular in shape, and bottom section 12 is also square or rectangular in shape, and is preferably integrally attached to each of side sections 14, 16, 18, and 20.

Figure 7:
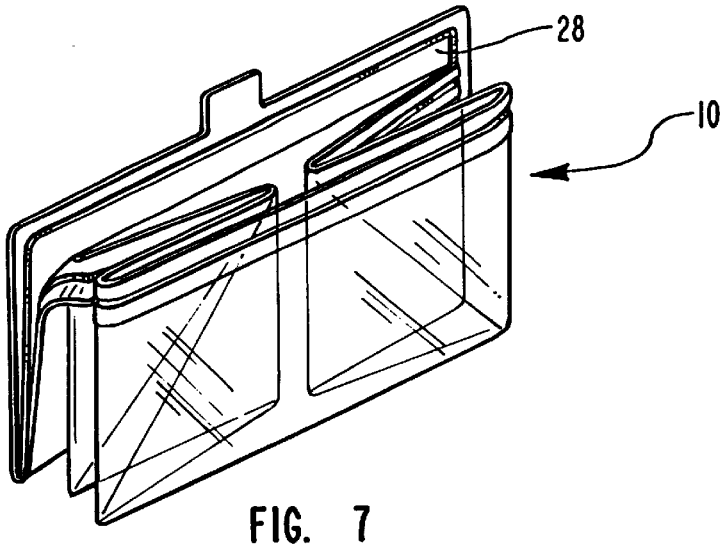
FIG. 7 is a perspective view of a self-standing container of FIG. 6 shown in the fully folded position thereof with the lid of the container folded to reduce the surface area of the fully folded position.
Figure 9:
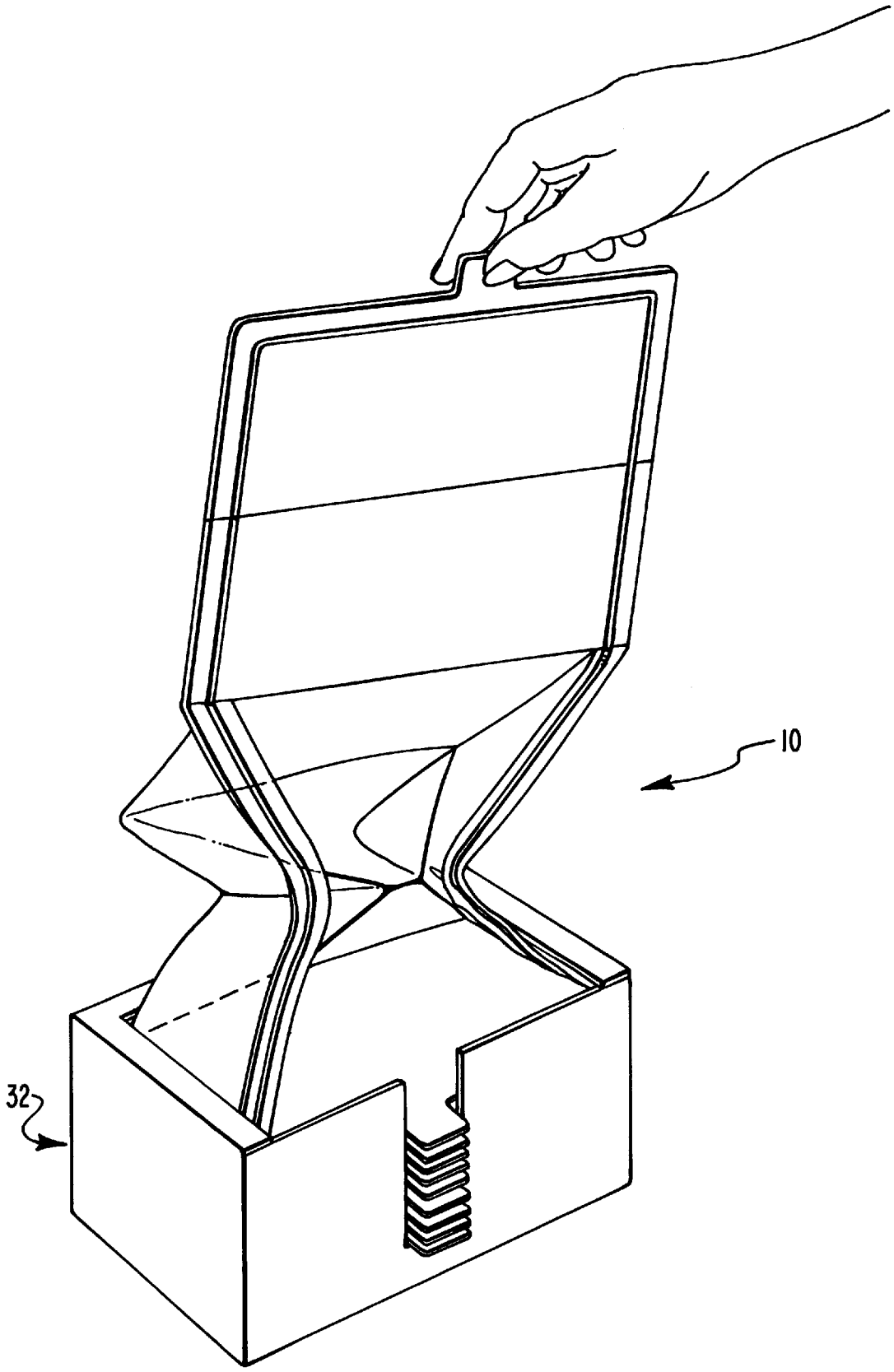
FIG. 9 is a perspective view of one of the self-standing containers seen in FIG. 8 being dispensed from the bulk dispenser into the upright, self-standing position thereof
Figure 10:
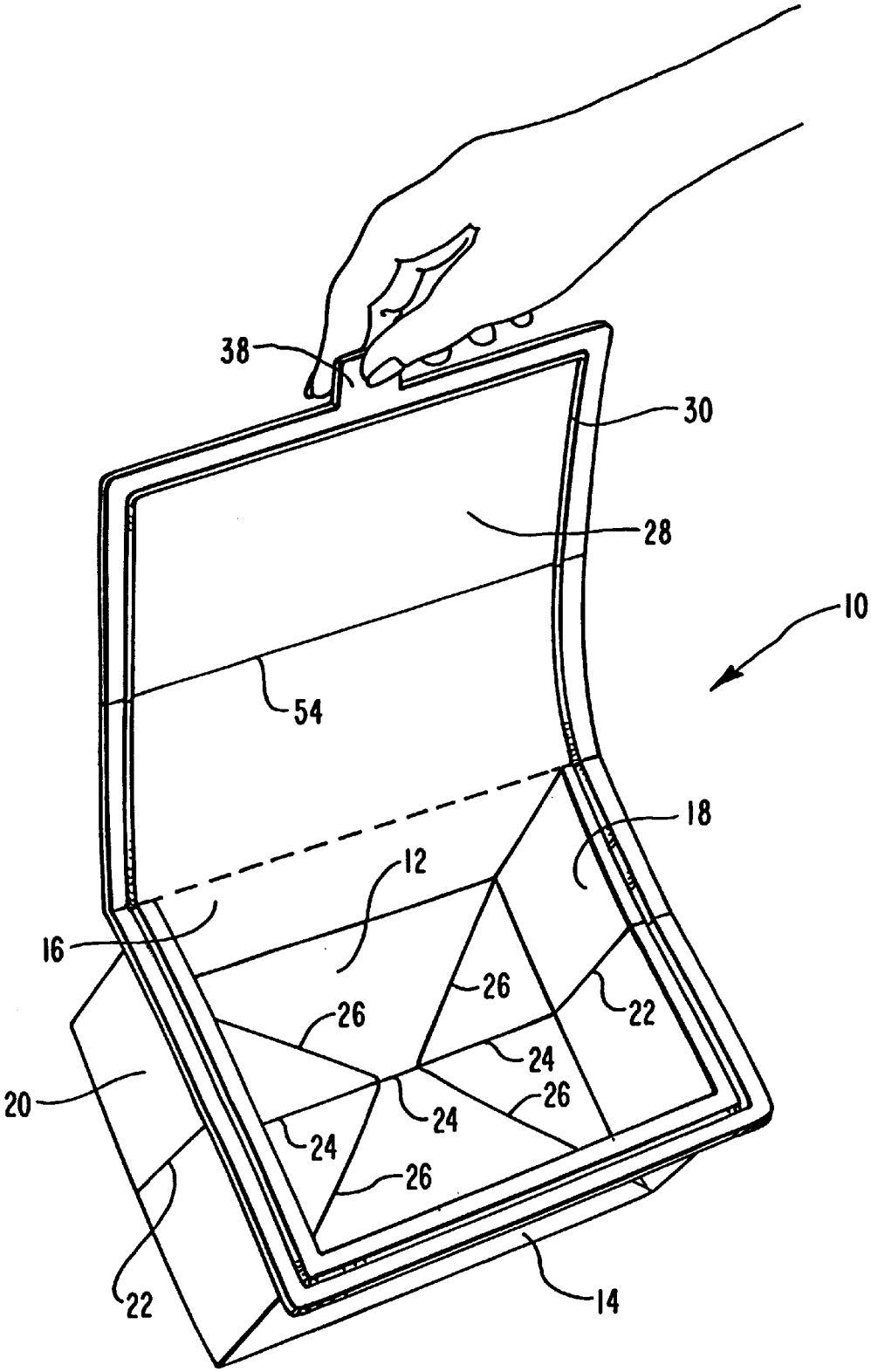
FIG. 10 is a perspective view of the self-standing container in the upright, self-standing position thereof, seen in FIG. 9, after having been removed from the bulk dispenser and also showing the locations of the folds used to reduce the self-standing container into the folded position.

FIG. 7 shows self-standing container 10 in the folded position thereof. One arrangement for adapting self-standing container 10 into both the folded position thereby, seen in FIG. 7, and into the separate upright self-standing position thereby, seen in FIG. 3, is depicted in FIG. 10. This includes a single vertical fold line 22 in each of right side section 18 and left side section 20, each fold line 22 extending vertically completely through the center of the side section thereof Bottom section 12 is also provided with a longitudinal fold line 24 extending through its center and meeting with the vertical fold lines 22 of the right and left side sections 18 and 20. Four diagonal fold lines 26 stem from center fold 24 of bottom section 12, and each extends to one of the four corners of self-standing container 10. When bottom section 12 is square in shape, diagonal fold lines 26 will meet at the center of the longitudinal fold. When bottom section 12 is rectangular, diagonal fold lines 26, being at 45° angles from fold line 24, will begin a distance apart from each other. Such an arrangement is shown in FIG. 9. The fold lines of the above-recited means for adapting self-standing container 10 into both a folded position and alternately an upright, self-standing position are also shown with dashed lines on the blank of FIG. 1.

In order to collapse self-standing container 10 into the folded position whereby self-standing container 10 is highly compact for storage and transport when empty, the fold lines discussed above and shown in FIG. 10 are formed. This can be accomplished by any conventional method, but it is preferred that the fold lines are pressed into the blank of self-standing container 10 or are created with a box folding device, as will later be explained. Next, in transforming self-standing container 10 into the folded position, right side section 18 and left side section 20 are folded over by pressing fold lines 22 inward toward the interior of container 10. Diagonal fold lines 26 are concurrently raised upward. This causes horizontal fold line 24 to hinge in the center and be divided into two or more segments. The segments of horizontal fold line 24 fold over and are drawn into the interior. The two segments become vertical and parallel to each other. They also become parallel to and adjacent to fold lines 22 at the interior of the container.

Figure 6:
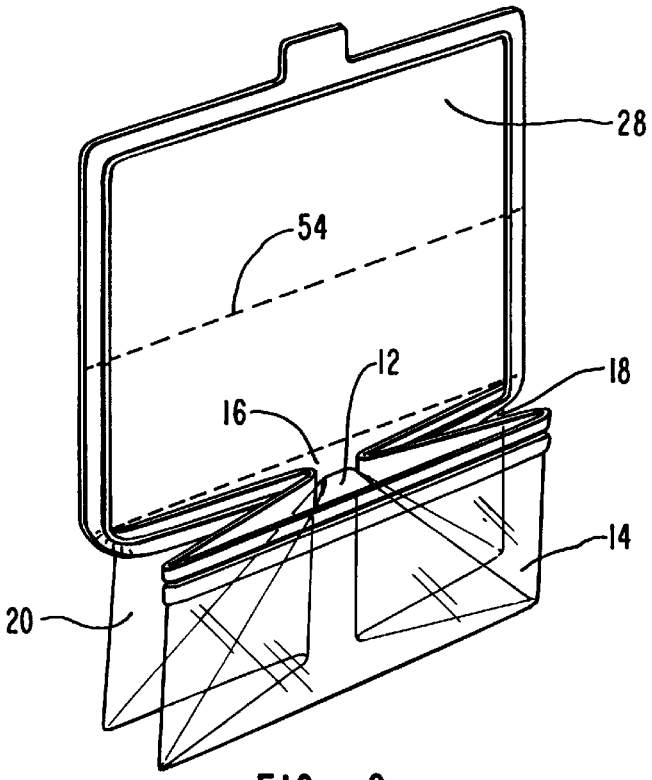
FIG. 6 is a perspective view of the self-standing container in the folded position seen in FIG. 5 after having been removed from the box folding device seen in FIGS. 4 and 5.

When the bottom of self-standing container 10 is rectangular, horizontal fold line 24 hinges at the intersect points where diagonal fold lines 26 meet horizontal fold line 24. This divides horizontal fold line 24 into 3 segments, two or more of which may be equal in length. The two segments on either end of horizontal fold line 24 fold over and are drawn into the interior to become parallel to each other. Such an arrangement is shown in FIGS. 6 and 7. Bottom section 12 of container 10, seen in FIG. 10, is also formed into six portions comprising two trapezoids and four triangles if bottom section 12 is rectangular as shown, and six triangles if bottom section 12 is square. The trapezoids or triangles overlap accordion style to form four layers, as can be seen in FIGS. 6 and 7. Front side section 14 and rear side section 16 remain unfolded and adjacent with side sections 18 and 20 and bottom section 12 collapsed between them.

The preferred relative dimensions of self-standing container 10 comprise each side section having a length that is twice as long as its height. The bottom section is preferably square and of the same length as the sides. Other relative dimensions could also be used and would fall within the scope of the present invention.

In the folded position shown in FIGS. 6 and 7, bottom section 12 is folded between front and rear side sections 14 and 16 and does not extend beyond the top edge of front and rear side sections 14 and 16. It should be seen, however, that if the relevant dimensions were changed such that side sections 14, 16, 18, and 20 were shorter, folded bottom section 12 would extend beyond side sections 14, 16, 18, and 20. Such a dimension may be useful, for instance, in the production of clothing boxes, and is considered to be within the scope of the present invention. Two such clothing boxes might be produced without lids and fitted one within the other when in the self-standing position, in the manner known in the art.

Self-standing container 10 is provided with a lid 28 that is folded over using a fold line 54 extending horizontally through the center thereof, as is also shown in FIGS. 6 and 7. When lid 28 is in the folded position, as shown in FIG. 7, container 10 will be essentially flat and the folded position thereof will have a reduced surface area substantially equal to the shape of either front or rear side sections 14 and 16. Of course, other relative dimensions could also be used. For instance, if the side sections are relatively short, a portion of the folded bottom section would protrude past the tops of the front and rear side sections.

Lid 28 may be attached to one or more sides of self-standing container 10, and in the embodiments of FIGS. 1–10, is attached to rear side section 16. Lid 28 may have a flap that is inserted inside self-standing container 10 as with many conventional paper boxes, or it may be made of vinyl plastic and zippered around the remaining three sides for sealing the self-standing container 10 in an airtight manner as shown in FIGS. 2 through 10.

Using a zipper-type closure device 30, self-standing container 10 can be used to store and preserve perishable items such as fresh food, leftovers, frozen food, etc. Self-standing container 10 is thereby an excellent replacement for sandwich or freezer bags, as it is easier to fill, easier to stack, and will retain its shape. It is also highly advantageous for microwave use as the contents may be stored with the bag sealed and then heated in the microwave with the bag open.

Self-standing container 10 can be formed of plastic, paper, cardboard, or any other suitable material. When self-standing container 10 is formed out of a flexible material such as vinyl plastic it will maintain a self-standing position when open. It will also have the added benefits of being sealable, if necessary, and it will be easily collapsed into the compact, folded position when empty.

Figure 11:
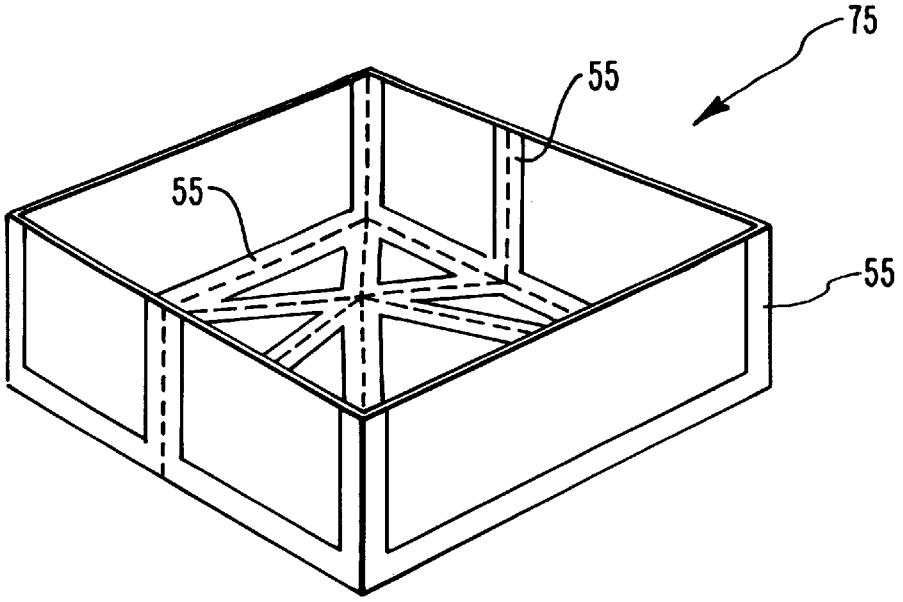
FIG. 11 is a perspective view of an embodiment of the self-standing container of the present invention, which embodiment is made of discrete segments of a rigid material connected together at the joints with a liquid-tight and/or heat resistant adhesive material.

Metal or other rigid materials may also be used to form the self-standing container of the present invention. When using a rigid material such as metal, the fold lines are preferably made in the form of joints, with the material being made thinner at the fold lines by serration or creasing. The fold lines may also be created by joining together individual and discrete plates having boundaries corresponding to the fold lines shown in FIG. 1. The plates can be joined together at the boundaries to form fold lines with a resilient, watertight adhesive material such as tape. An embodiment of the self-standing container made of plates of a rigid material connected together at the boundaries to form fold lines with an adhesive material 55 is shown in FIG. 11 and generally designated at 75. Where adhesive material 55 is used and is liquid-tight, fluids may be contained therein. Where adhesive material 55 is heat resistant, self-standing container 75 can be used for cooking and is particularly suitable for camping and backpacking. Hinges or other forms of joints could also be used to join the individual plates.

Figure 12:
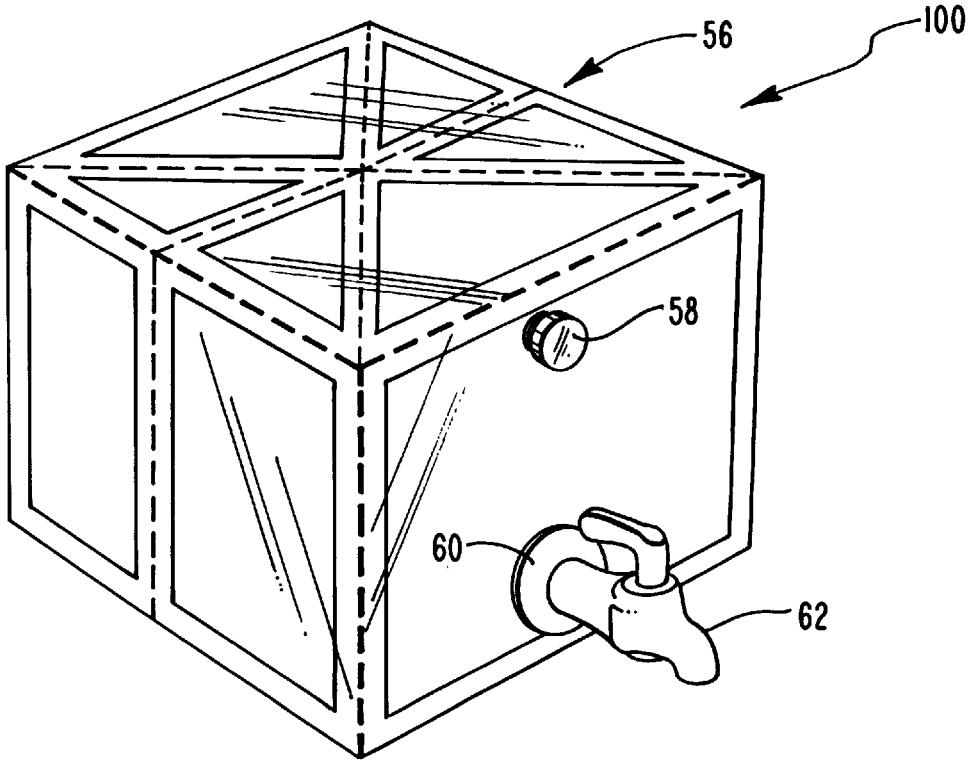
FIG. 12 is a perspective view of an embodiment of the self-standing container of the present invention, which has an integral top section having folds identical to the bottom section, and has a filling port and a spout.

The embodiment of FIG. 12 shows a self-standing container 100 provided with an integral top section 56. Self-standing container 100 is preferably formed of a rigid material, but it should be evident that any other suitable material could be used, including vinyl plastic. When forming integral top section 56, two self-standing containers such as self-standing container 75 of FIG. 11 are preferably connected together end to end. Integral top section 56 can also be attached directly to the top of the side sections.

A port 60 having a spout 62 may be attached to one side section as a means for providing access to the interior of self-standing container 100, and a second port 58 may also be used to fill self-standing container 10 and to allow air in when drawing the contents out. Alternatively, second port 58 may remain closed when dispensing contents, in which case self-standing container 100 would self-collapse as its contents were being withdrawn. Thus, when empty, container 100 would be already folded and ready for transport.

The embodiments of the self-standing container of the present invention designated as self-standing container 75 and self-standing container 100 are intended to be configured with the same arrangement as that described above for adapting self-standing container 10 into both the folded position and into the separate, upright self-standing position. Thus, self-standing containers 75 and 100 can be reduced into the folded position in substantially the same manner as that previously described for self-standing container 10. However, it should be evident that top section 56 of self-standing container 100 folds downward toward the center of self-standing container 100 while the bottom of container 100 folds upward in the same manner, as discussed and shown for self-standing container 10 of FIGS. 1 through 7, when reducing self-standing container 100 to the folded position.

Figure 13:
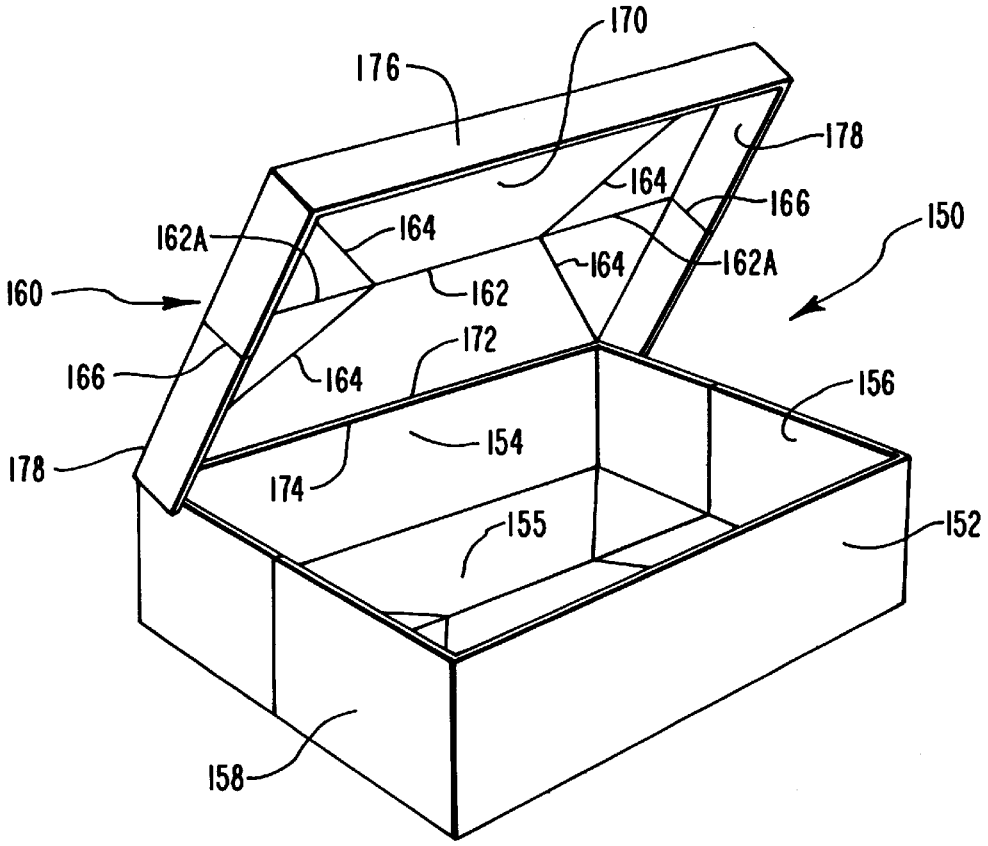
FIG. 13 is a perspective view of an embodiment of the self-standing container of the present invention, which has an integral lid with folds therein formed in the mirror image of the folds used to reduce the rest of the self-standing container into the folded position.
Figure 14:
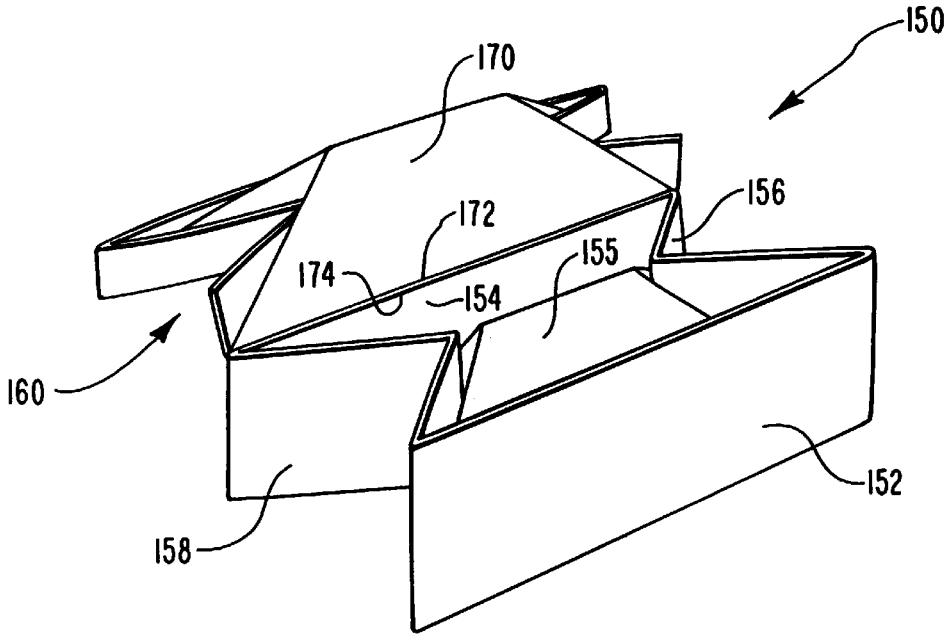
FIG. 14 is a perspective view of the self-standing container seen in FIG. 13 shown in an intermediate position between the folded and the self-standing positions.
Figure 15:
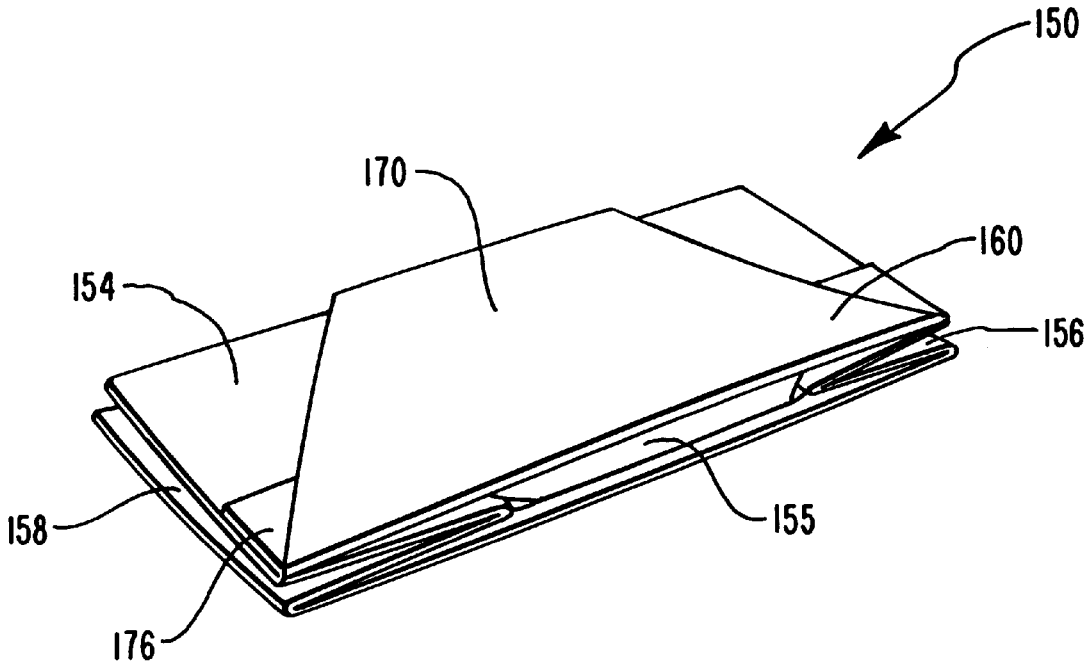
FIG. 15 is a perspective view of the self-standing container seen in FIG. 14 after being reduced to the folded position.

The embodiment of FIGS. 13 through 15 show a self-standing container 150 provided with an integral foldable lid 160. Foldable lid 160 is integrally attached to the rear side section 154 of self-standing container 150 and is provided with a front skirt section 176 and two side skirt sections 178. Foldable lid 160 is provided with fold lines 162 and 164 in the top section 170 and fold lines 166 in side skirt sections 178. Fold lines 162, 164 and 166 are formed in the mirror image of the fold lines of the bottom section 155. The fold lines of bottom section 155 are formed in the same manner as those described above for self-standing containers 10, 75, and 100.

In reducing self-standing container 150 to the folded position, the same procedure is followed as described above for self-standing container 10, but lid 160 is also folded, as shown in FIG. 14. Lid 160 can be folded at the same time as bottom section 155 and side sections 152, 154, 156, and 158 are folded, or it can be folded afterwards. In either case, vertical fold lines 166 are pressed inward. This hinges horizontal fold line 162 to form at least two segments 162A. Segments 162A are drawn inward toward the center of foldable lid 160, while the center of horizontal fold line 162 is pressed upward, as shown in FIG. 14. Segments 162A become parallel to each other and parallel to vertical fold lines 166. Top section 170 folds into six portions which overlap in four layers.

At this point, foldable lid 160 will extend above rear side section 154 of folded self-standing container 150. Self-standing container 150 can be stored and distributed in this configuration, or it may be further reduced into the folded position by tucking foldable lid 160 over against rear side section 154 of self-standing container 150. In doing so it is helpful to form the hinge between lid 160 and rear side section 154 with two fold lines 172 and 174 arranged in close proximity to each other to give room for folded lid 160 to tuck up against rear side section 154. Self-standing container 150 is shown in FIG. 15 in the folded position.

Returning self-standing container 150 to the self-standing position from the folded position requires two steps. First, lid 160 is untucked to once again extend above rear side section 154 of self-standing container 150. Then front skirt 176 of lid 160 and front side section 152 are pulled against each other to return self-standing container 150 to the self-standing position. FIG. 14 shows self-standing container 150 as it would be when partially pulled apart. FIG. 13 shows self-standing container 150 as it will appear after being returned to the self-standing position where it is ready to be filled.

Self-standing container 150 is shown with a rectangular bottom section 155, but bottom section 155 could also be square. Other relative dimensions of self-standing container 150 could also vary, as discussed above for self-standing container 10. Self-standing container 150 is highly beneficial as a gift or clothing box and is preferably made of cardboard or paperboard, though other materials could also be used.

In a similar embodiment, rather than integrally attaching a foldable lid, two lidless self-standing containers (not shown in the figures) could be used, with one being slightly larger than the other. The contents of the smaller self-standing container could then be enclosed by placing the second self-standing container, which becomes the lid, over the first in the manner commonly used in the art. The advantage added by the present invention is that when using the fold lines described for each of the previous embodiments, each of the first and second self-standing containers can be reduced to the compact folded position for distribution and storage when empty.

Figure 8:
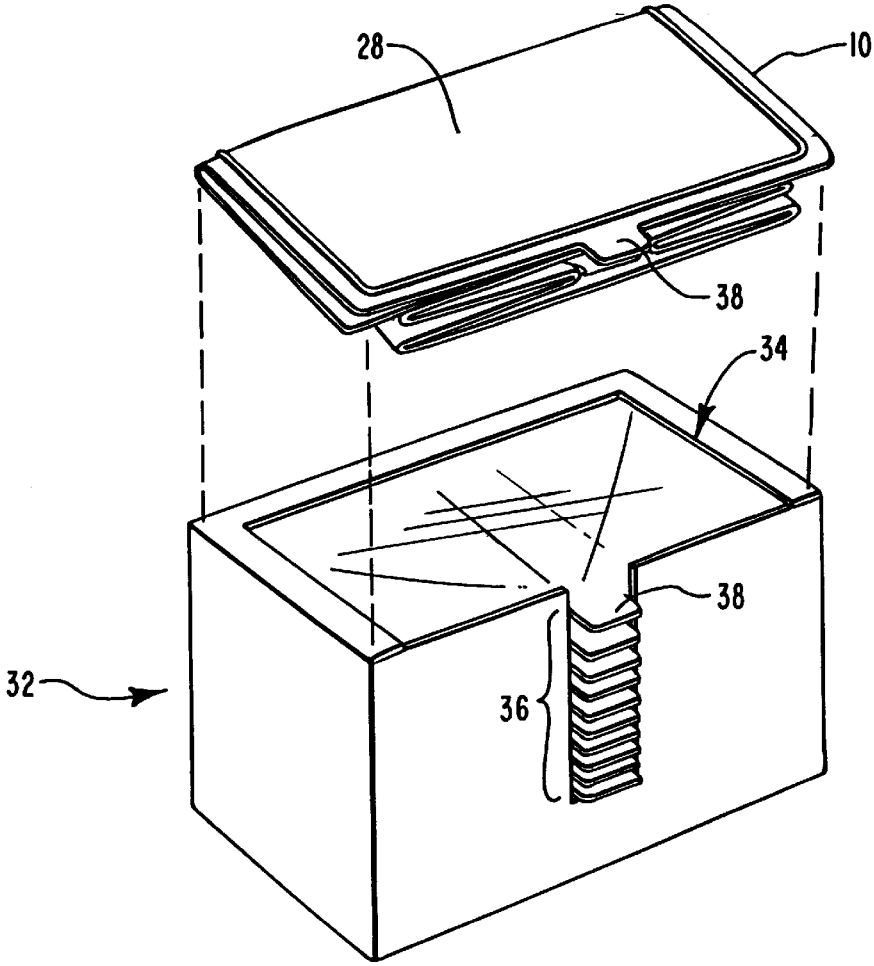
FIG. 8 is a perspective view of a plurality of the folded self-standing containers seen in FIG. 7 inserted into a bulk dispenser.

Furthermore, a bulk dispensing container such as that of FIGS. 8 and 9 could be used to efficiently store and disperse the self-standing containers. Bulk dispenser 32 might, of course, need to be modified when using less flexible materials such as cardboard or paper board for the self-standing containers. For instance, opening 34 may be enlarged and a tab, such as tab 38, could be used, but might be located on a portion of the self-standing container other than a lid.

Figure 1:
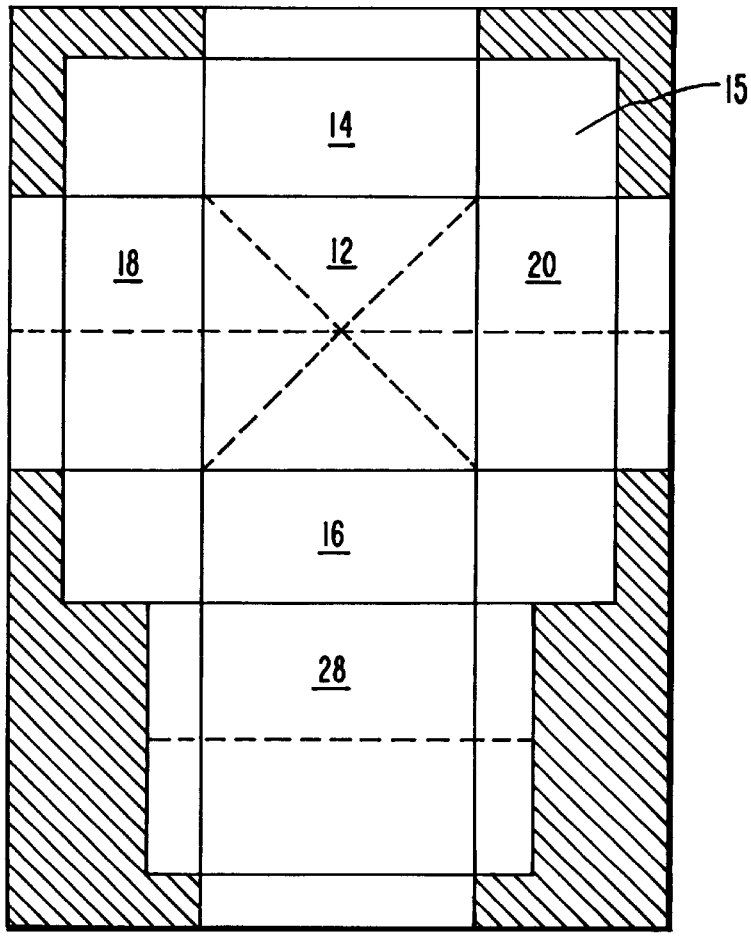
FIG. 1 is a pattern for a blank of the container of the present invention showing the areas to be cut away and the basic folds to be made. Shown with dotted lines are the folds to be made at the time of reducing the self-standing container to a folded position.
Figure 2:
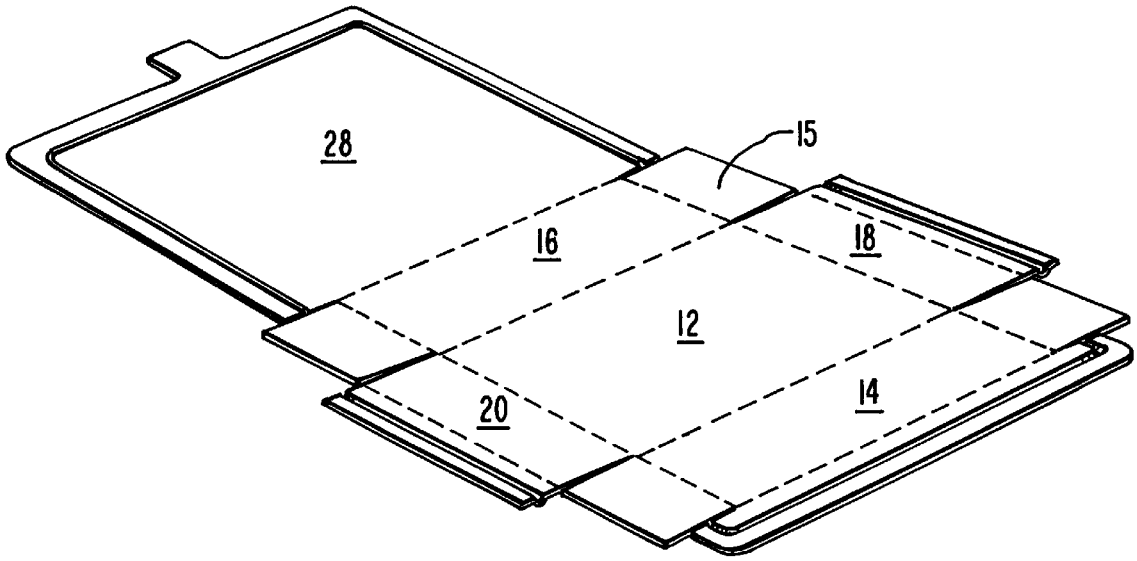
FIG. 2 is a perspective view of the blank seen in FIG. 1 after being stamped, with added zipper-type closing features, and before being fastened together at the corners.

A method of manufacturing of self-standing container 10 is also part of the present invention. The method of manufacturing of the present invention is illustrated in FIGS. 1 through 7 and comprises first providing a flat sheet of material of which the inventive, self-standing container 10 is to be made. The flat sheet of material is then stamped from a pattern, shown by way of example in FIG. 1, to form the blank of FIG. 2, having a bottom section 12, four side sections 14, 16, 18, and 20 and lid 28, if a lid is required. Folds are then stamped, serrated, or otherwise creased between bottom section 12 and side sections 14, 16, 18 and 20. A fold is also stamped between side section 16 and lid 28, as shown in the template of FIG. 1. The folds to be formed at this time are also shown by the dotted lines of the blank of FIG. 2. The four side sections 14, 16, 18, and 20 are then folded upward and adhered together at the edges. This is preferably done in a liquid-tight and airtight manner such as gluing or heat sealing to form self-standing container 10, as shown in FIG. 3. If a paper board box is designed to be made, however, the side sections should be glued or attached with slots or any other known method of paper board box making. The fold lines required to make the self-standing container lie flat, as designated by the dotted lines in FIG. 1, may also be formed at this time. This is not always necessary at this point, however, as the fold lines can be formed by later processes, as will be explained.

The template for self-standing container 10, as seen in FIG. 1, could of course be modified to have different dimensions. It may be provided with a lid 28, as shown, or it may be formed without lid 28 as is container 75 of FIG. 11. The template of FIG. 1 could also be formed with an integral top section for forming containers with a fully closed configuration such as that of self-standing container 100 of FIG. 12. As discussed above and shown in FIG. 11 with respect to container 75, joints could also be formed at the fold lines from separate and discrete self-standing plates cut from boundaries designated by the fold lines, with the separate pieces being fastened with a hinge, adhesive material, or other known methods.

Where a zipper-type closure device 30 is to be used on self-standing container 10, as shown in FIGS. 1 through 10, any conventional method can be used to form zipper-type closure device 30. In one embodiment given by way of example, zipper-type closure device 30 is separately formed as two integral three-sided inserts, one male and one female. The two three-sided inserts are attached, one to lid 28 and one to the tops of front and right and left side sections 14, 18, and 20, as shown in FIGS. 3 through 10, to form a sealing structure on self-standing container 10.

The present invention also provides a method of creating a curvature in a plastic zipper-type closure device. The curved zipper type closure device is used to form a three sided insert, which in one embodiment is an integral single piece, one or more of which are attached to self-standing container 10. In one embodiment, zipper-type closure device 30 of FIG. 10 is formed with two such closure devices.

Under this embodiment, two integral three-sided inserts, one having at an outer edge thereof a bead portion and one having at an outer edge a groove portion, are attached to self-standing container 10. To form the structure of FIG. 10, one such insert is attached to lid 28, and one such insert is attached extending outward perpendicularly to sides 14, 18, and 20. In one embodiment, wherein the three-sided insert is a single integral piece, this is accomplished after self-standing container 10 has been stamped and the corners fastened together.

Figure 29:
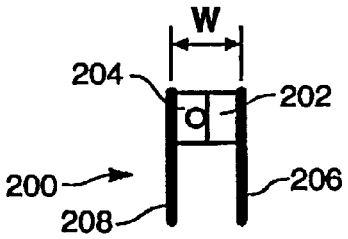
FIG. 29 is a front view exhibiting the width dimension of another bead and groove closure device.
Figure 30:
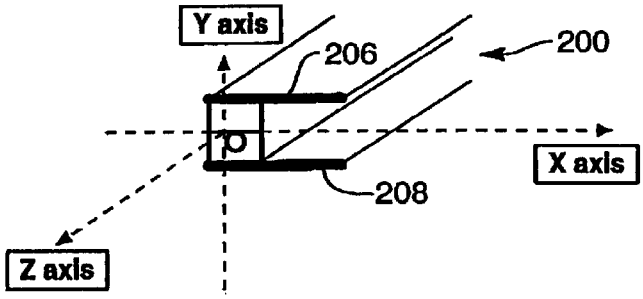
FIG. 30 is a perspective view exhibiting the X, Y, and Z axis of the bead and groove closure device of FIG. 29.
Figure 31:
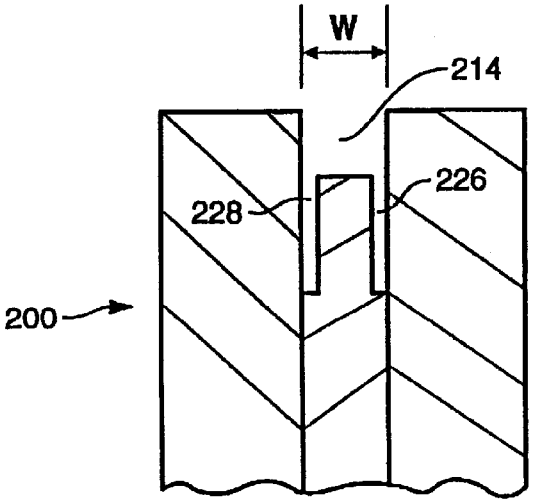
FIG. 31 is a cross-sectional view taken through line 31—31 of FIG. 32 of a template for receiving the bead and groove closure device of FIG. 29.

One currently available plastic zipper-type closure device takes the form of an elongated bead which is releasably inserted within an elongated groove to make a resilient, conformable, and essentially air-tight seal. One example of such a zipper-type closure device 200 is that used for sealing plastic bags such as the Baggies™ brand plastic bags. Plastic zipper-type closure devices 200 come in several forms, including those without lips, as shown in FIGS. 16 through 19 and those formed with lips 206 and 208, as shown in FIGS. 29 and 30. Lipped zipper-type closure devices can be configured with a lip on one side, two lips on the same side, as shown in FIGS. 29 and 30, or with a lip on either side.

Figure 16:
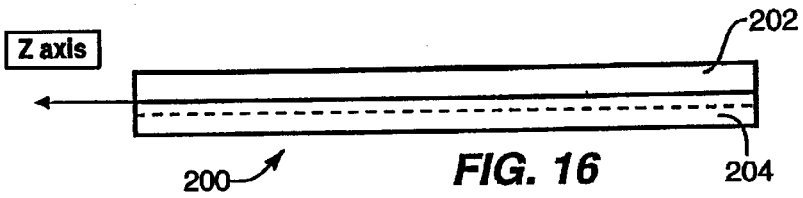
FIG. 16 is a side view of a linear bead and groove closure device.
Figure 18:
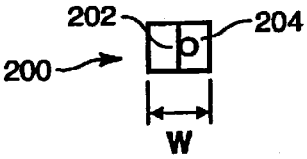
FIG. 18 is a rotated front view exhibiting the width dimension of the linear bead and groove closure device of FIG. 16.
Figure 19:
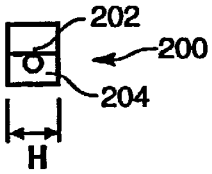
FIG. 19 is a front view exhibiting the height dimension of the linear bead and groove closure device of FIG. 16.

FIG. 16 is a side view showing a Z axis of a bead and groove closure device 200 in which a bead portion 202 and a groove portion 204 are fastened together to form a substantially air-tight seal. FIG. 18 is a front view of bead and groove closure device 200 showing a Y axis and an X axis.

In solving the problem of forming a permanent curvature in plastic zipper-type closure device 200 without deforming bead and groove closure device 200 and thereby destroying the capability of forming an air-tight seal, it has been discovered that heating and subsequently cooling zipper-type closure device 200 while bead and groove closure device 200 is adhered to a template having the selected curvature causes zipper-type closure device 200 to permanently assume the selected curvature.

Figure 20:
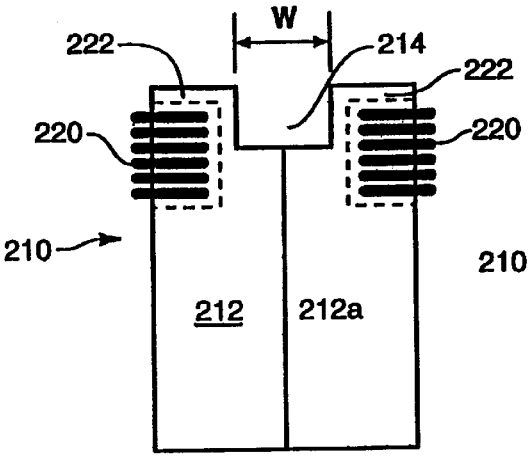
FIG. 20 is a cross-section of a template for forming a curvature in a linear bead and groove closure device taken between line 20—20 of FIG. 21.
Figure 21:
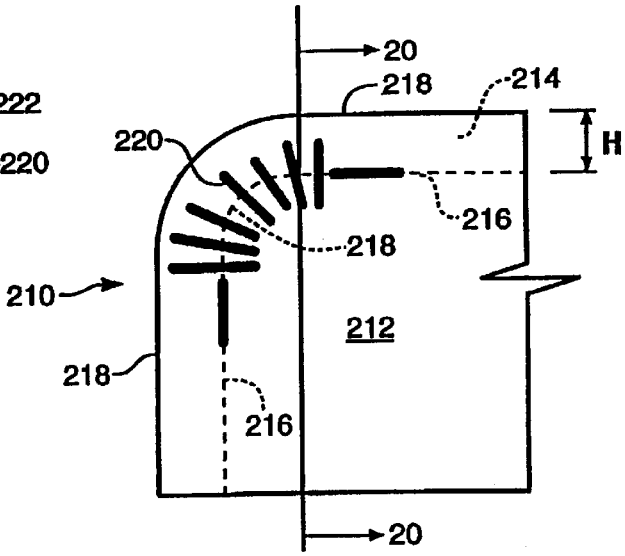
FIG. 21 is a side view of the template of FIG. 20.

FIG. 20 is a cross-sectional view of a representative template 210 taken through line A—A of FIG. 21. FIG. 21 is a side view of template 210. Template 210 is, in the depicted embodiment, formed from two machined slabs of metal 212, 212*a* having therein a forming slot 214. Forming slot 214 has a bottom surface formed with two straight portions 216 and a curved portion 218. Forming slot 214 is of a width W and a height H sized to snugly accommodate bead and groove closure device 200 therein. A pair of electrical heating coils 220 are embedded within sides 222 of the template 210 adjacent the forming groove 214.

Figure 23:
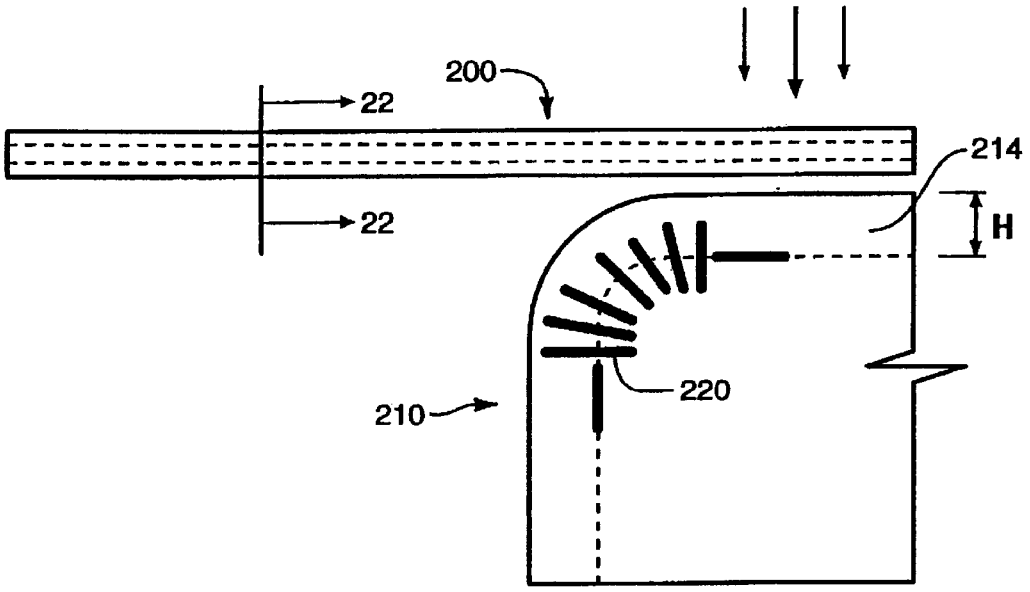
FIG. 23 is a side view showing an initial position of the bead and groove closure device of FIG. 22 relative to a template.
Figure 24:
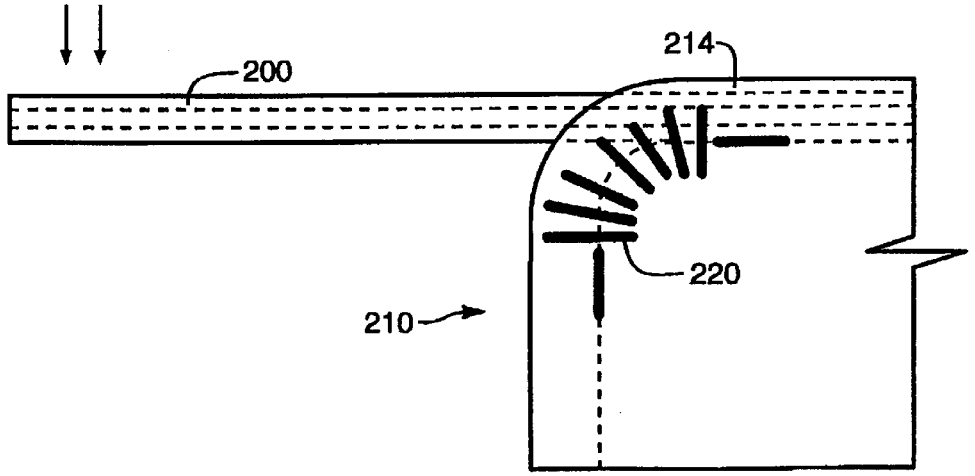
FIG. 24 is a side view showing an intermediate position of the bead and groove closure device of FIG. 22 wherein an initial edge of the bead and groove closure device of FIG. 22 is inserted within a slot of the template of FIG. 23.
Figure 25:
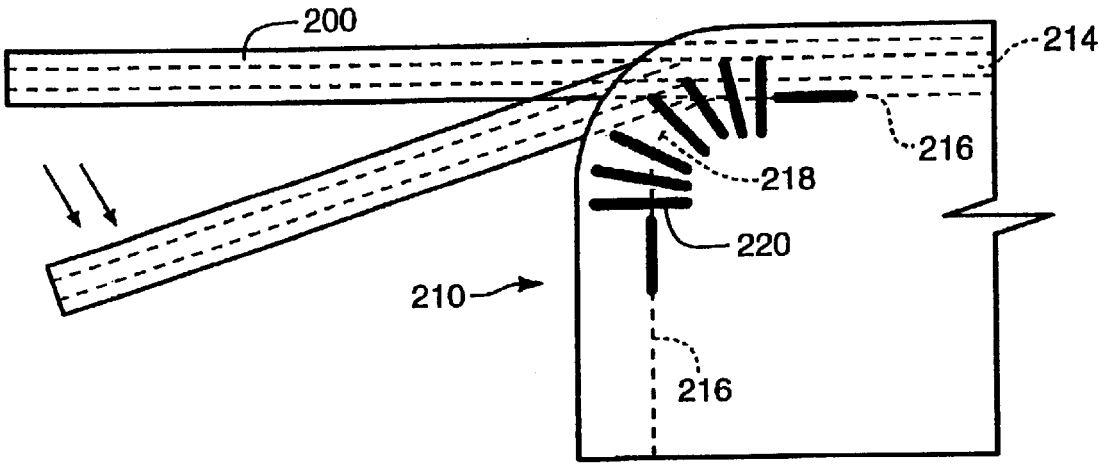
FIG. 25 is side view showing a further position of the bead and groove closure device of FIG. 22 relative to the template of FIG. 23.
Figure 26:
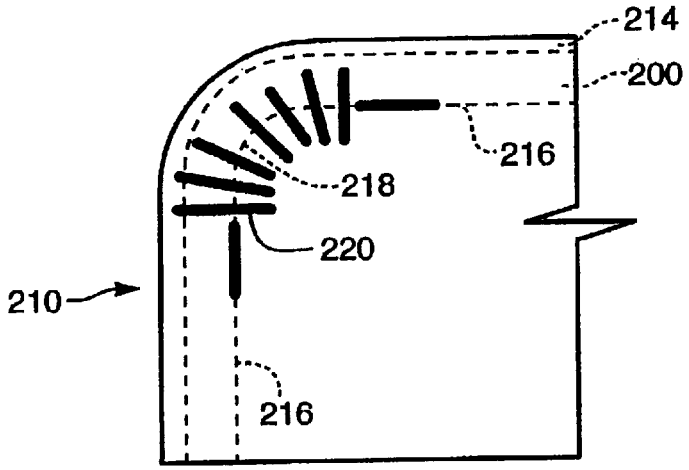
FIG. 26 is a side view showing the bead and groove closure device of FIG. 22 entirely inserted in the slot of FIG. 23.

Under the method of the present invention, an initial edge of bead and groove closure device 200 is placed within one end of forming slot 214. Pressure is gradually applied to bead and groove closure device 200 as shown by the arrows of FIGS. 23 through 25 and exerted at a point located progressively outward from the initial edge. Heat is concurrently applied through heating coils 220 so that the portion of bead and groove closure device 200 contacting heating coils 220 is gradually heated to an elevated temperature as it progressively conforms to curved portion 216. Bead and groove closure device 200 is retained within forming slot 214 for a selected amount of time until bead and groove closure device 200 has completely assumed the radiused curvature of template 210 as shown in FIG. 26. The step of conforming bead and groove closure device 200 to template 210 can be conducted manually or can be accomplished through mechanical or robotic means. It should also be apparent to one skilled in the art that the entirety of the portions of bead and groove closure device 200 that are intended to be curved could be initially pressed against template 210 (appearing as shown in FIG. 26), and the heat thereafter applied to the entirety of the portions intended to be curved at the same time or at about the same time.

The heat applied to bead and groove closure device 200 is preferably in an amount sufficient to raise the temperature of bead and groove closure device 200 to the temperature of plasticity of the bead and groove closure device 200. The temperature of plasticity, as used herein, is the temperature at which bead and groove closure device 200 is soft such that a slight pressure deforms bead and groove portions 202, 204, but bead and groove portions 202, 204 do not deform or melt in the absence of an applied pressure. The elevated temperature can be applied in any known and suitable manner. Examples of suitable manners include depicted electrical heating coils 220, thermal heat such as heated fluid and resistance wire, heated air, and high intensity light such as ultrasonic light, ultra-violet light, and infra-red light.

Figure 27:
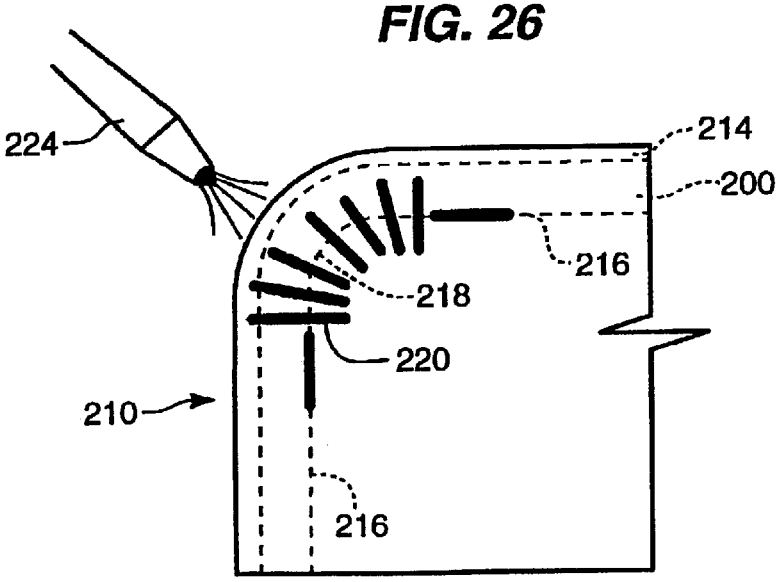
FIG. 27 is a side view showing a nozzle used to cool the bead and groove closure device of FIG. 22.

The elevated temperature is maintained for a short duration of time, generally up to about a minute, depending on the temperature applied and the thermoplastic properties of bead and groove closure device 200. Once bead and groove closure device 200 completely conforms to template 214, bead and groove closure device 200 is cooled back down to room temperature. Cooling permanently solidifies the closure device in its new shape, due to the thermoplastic properties of the plastic. Cooling can be accomplished by merely allowing time for the heat to dissipate to the surrounding ambient, or can be achieved through forced and controlled cooling such as blowing cold air or other types of gas through a nozzle 224 as shown in FIG. 27. Once the closure device has cooled, it will permanently retain its shape without losing its gripping and sealing abilities.

Figure 17:
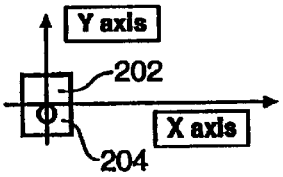
FIG. 17 is a front view of the linear bead and groove closure device of FIG. 16 showing the X and Y axis.
Figure 22:
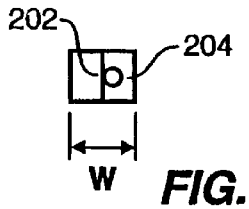
FIG. 22 is a cross-sectional view of a bead and groove closure device taken through line 22—22 of FIG. 23.

FIGS. 22 and 23 show a preferred orientation of bead and groove closure device 200 within forming slot 214. FIG. 17 is a cross sectional view taken through line B—B of FIG. 23. With the depicted orientation, bead portion 202 and groove portion 204 are consistently formed, such that each has a uniform curvature relative to the other, thereby facilitating a proper air-tight seal. It is preferred that bead portion 202 and groove portion 204 be sealably fastened together during the heating and cooling process, but it is considered within the scope of the present invention to apply bead portion 202 and groove portion 204 separately to template 214 and to separately heat and cool each.

Figure 28:
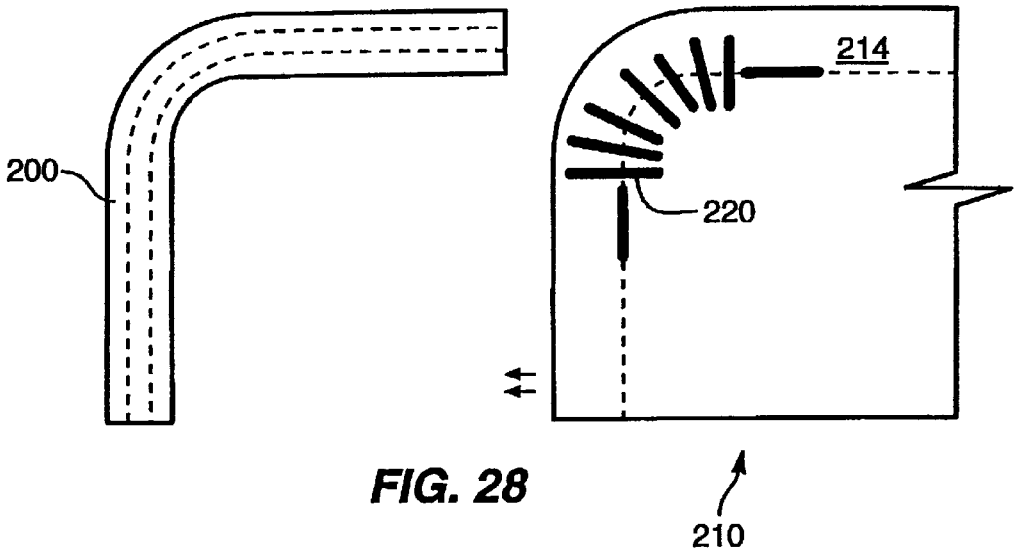
FIG. 28 is a side view showing the bead and groove closure device being removed from the template of FIG. 23.

FIG. 28 shows a final step of removing bead and groove closure device 200 from template 210. As seen therein, bead and groove closure device 200 has assumed a permanent curvature within the X-Z plane, and once separated, bead portion 202 and groove portion 204 can be sealably refastened together.

It is contemplated that the present method can be utilized with various sizes and configurations of bead and groove type closure devices. Appropriate modifications can be made to template 210 to accommodate the differing shapes. As an example, FIGS. 28 through 31 depict an embodiment in which bead and groove closure device 200 is provided with a pair of lips 206, 208. FIG. 29 is a frontal view of the lipped embodiment of bead and groove closure device 200, and FIG. 30 is a perspective view. Lips 206 and 208 are suitable for use as three-sided inserts as referenced above.

In the embodiment of FIGS. 28 through 31, template 210 is provided with a forming slot 214 that has two side recesses 226 and 228 for receiving lips 206 and 208. Bead and groove closure device 200 is inserted into forming slot 214 of FIG. 210 and in so doing, lips 206 and 208 are inserted into side recesses 226 and 228 respectively. Heat is then applied to bring bead and groove closure device 200 to the elevated temperature as discussed above, after which bead and groove closure device 200 is cooled and removed from template 214.

Figure 32:
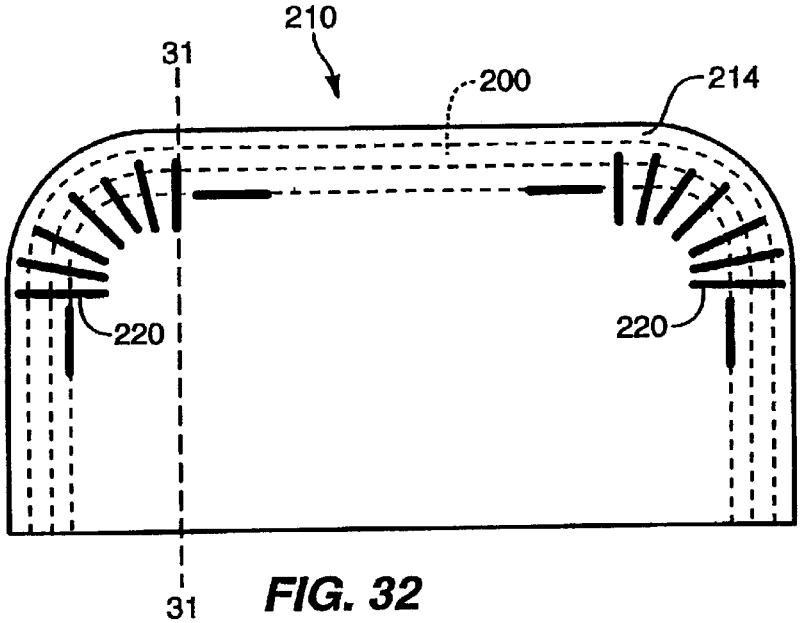
FIG. 32 is a template for forming double curvatures in a bead and groove closure device.

To form the three sided insert as zipper-type structure 30 of FIG. 10, two curvatures must be formed in each of bead portion 202 and groove portion 204. FIG. 32 shows a template 214 sufficient for so doing. Bead and groove closure device 200 is shown inserted within template 214 of FIG. 32. The manner of use of template 214 of FIG. 32 is substantially the same as that described above and will not be further described herein.

Figure 33:
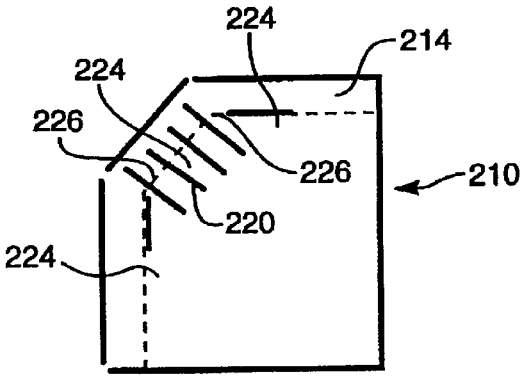
FIG. 33 is a template for forming an alternate curvature in a bead and groove closure device.
Figure 34:
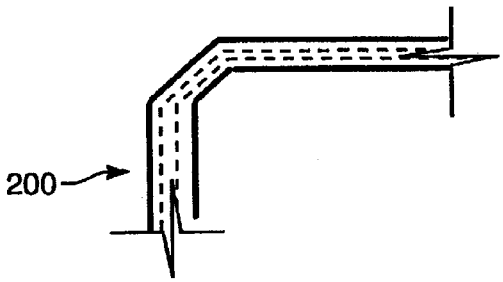
FIG. 34 is a bead and groove closure device exhibiting a curvature formed with the template of FIG. 33.

Of course, the curvatures formed into bead and groove closure device 200 need not be a constant radius as shown in the previously described embodiments. Template 214 of FIG. 33 is formed with an alternative curvature comprising two sharp bends 226 intermediate three straight sections 224. The use of template 214 of FIG. 33 results in bead and groove closure device 200 of FIG. 34.

Figure 4:
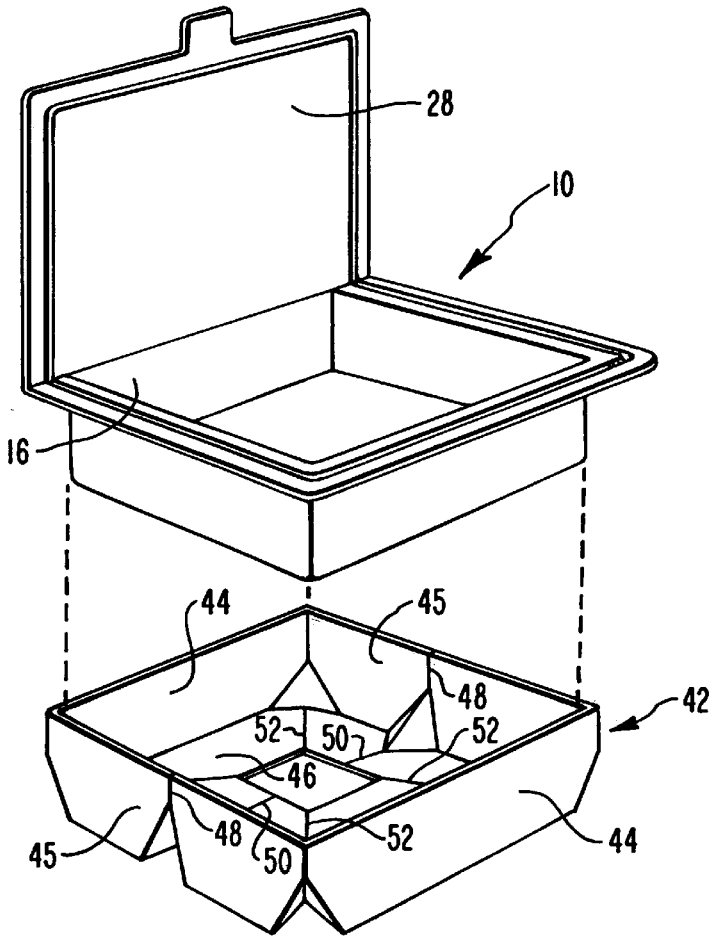
FIG. 4 is a perspective view of the self-standing container of FIG. 3 being inserted into a box folding device.

To fold self-standing container 10, a box folding device 42, as shown in FIG. 4, is used to transform self-standing container 10 into the folded position. Box folding device 42 comprises two first opposing side sections 44 and two second opposing side sections 45, as well as a bottom section 46, all made of a rigid material and having approximately the same fold lines designated thereon as those discussed above for the embodiments of FIGS. 6 and 7. Thus, box folding device 42 has a vertical fold 48 in second opposing side sections 45 and has a horizontal fold line 50 in bottom section 46 meeting with vertical fold lines 48. Four diagonal fold lines 52 extend from the center of bottom section 46 to each of the four outer corners of bottom section 46 of box folding device 42. Strategically placed cutouts located in side sections 44 and 45 as well as the center of bottom section 46 can also be formed to facilitate easier removal of folded self-standing container 10 from box folding device 42.

Figure 5:
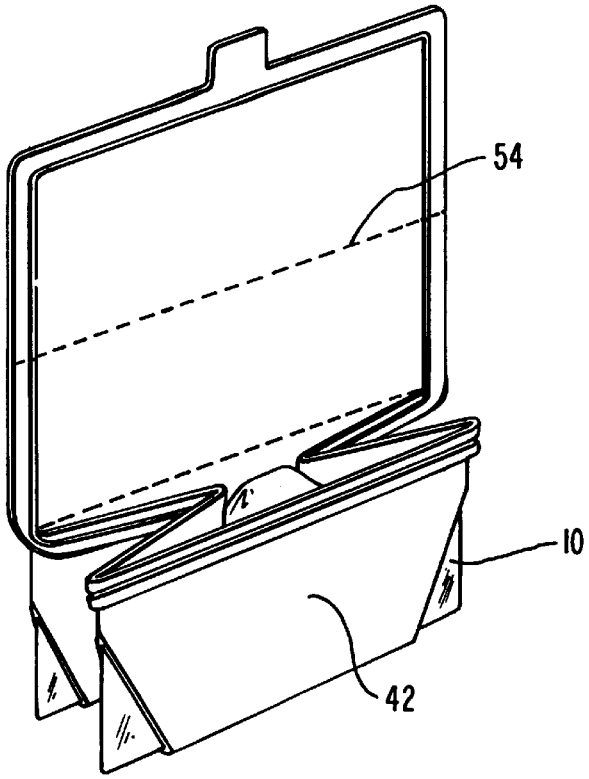
FIG. 5 is a perspective view of the self-standing container of FIG. 3 inside the box folding device of FIG. 4 with the box folding device reducing the self-standing container to a partially folded position thereof.

In using box folding device 42, self-standing container 10 is placed inside box folding device 42, as shown in FIG. 4, and box folding device 42 is transformed to lie flat in the folded position, as shown in FIG. 5. In doing so, second opposing side sections 45 are folded together. Diagonal fold lines 52 are pressed upward, and horizontal fold line 50 is pressed downward. This causes horizontal fold line 50 to hinge and fold over into two segments. The two segments of line 50 are drawn into the interior and become vertical and parallel to each other. They also become parallel to and adjacent to fold lines 48 of second opposing side sections 45. Bottom section 46 forms two trapezoids and four triangles if bottom section 46 is rectangular, and six triangles if bottom section 46 is square. The trapezoids or triangles overlap to form four layers, as can be seen in FIG. 5. First opposing side sections 44 remain unfolded and are adjacent, with second opposing side sections 45 and bottom section 46 folded and collapsed flat between them. Flattened container 10 is then removed from box folding device 42 in the folded position, as shown in FIG. 6.

Forming cutouts in the corners and center of box folding device 42, as discussed above and shown in FIGS. 4 and 5, will make it easier to remove self-standing container 10 once self-standing container 10 has been transformed into the folded position thereof, as seen in FIG. 7. Folding self-standing container 10 in the manner described above in box folding device 42, will form the dashed fold lines of FIG. 1 if they are not already formed. If the fold lines have been preformed, self-standing container 10 is still preferably reduced to the folded position in box folding device 42 as described and shown in FIGS. 4 through 7. If the fold lines have been preformed or sufficiently made permanent with box folding device 42, self-standing container 10, once unfolded into the self-standing position thereof shown in FIG. 3, can be again reduced to the folded position without the need for box folding device 42. Methods such as are generally known in the art for making folds may be used to make the folds permanent where it is desired that self-standing container 10 be refolded after use. Alternatively, the fold lines may be formed when the blank is stamped, as discussed above. Forming self-standing container 10 from a rigid material eliminates the need for using box folding device 42, as rigid self-standing containers with preformed fold lines, hinges or other such methods of creating fold lines are easily reduced to the folded position by hand.

The next step in reducing container 10 to the folded position is preferably to fold lid 28 in two, if present, at fold line 54 and then to further fold lid 28 against rear side section 16 of self-standing container 10, as shown in FIG. 7, to reduce the surface area of self-standing container 10. Folded self-standing container 10 may then be placed in a bulk dispenser, as will hereafter be explained, or may otherwise be bundled in bulk with other such containers for storage and distribution. This process, as will be appreciated by one skilled in the art, is easily automated so that the self-standing containers can be rapidly and inexpensively produced in high volumes.

It should be readily apparent that, while the preferred embodiment is made of flexible plastic, other materials are also suitable. For instance, when made of rubber or heavier more inflexible plastic, the self-standing container becomes more durable and suitable for extended use and reuse, and when made of metal the self-standing container is suitable for use in cooking.

A method of dispensing the self-standing containers in bulk is also part of the present invention and is illustrated in FIGS. 8 through 10. The bulk dispensing method comprises a bulk dispenser 32 having six sides and an opening 34 in at least one side thereof. Each of a plurality of self-standing containers 10 are reduced to the folded position using the fold lines of FIGS. 1 and 10, preferably in conjunction with the method as taught above. The plurality of self-standing containers 10 are then inserted, one on top of another, into bulk dispenser 32, thereby occupying a minimum of space.

A notch 36 can be formed in bulk dispenser 32, extending from one edge of opening 34 down one side of bulk dispenser 32. A tab 38 is preferably attached to each lid 28 of folded self-standing containers 10, as shown, or alternatively to one side of each of self-standing containers 10. Tabs 38 are arranged to protrude through notch 36, as also shown in FIG. 8. Pulling on tab 38 of the top self-standing container 10 will first draw out lid 28 of top self-standing container 10, as shown in FIG. 9, and will then draw out the remainder of top self-standing container 10 behind it, as shown in FIGS. 9 and 10. Each of self-standing containers 10 can thereby be efficiently dispensed from bulk dispenser 32 in turn. Forming opening 34 in the bulk dispenser 32 to be slightly smaller than the folded surface area of self-standing container 10 will provide a resistance against the pulling force, such that as container 10 is removed from bulk dispenser 32 by pulling on tab 38, container 10 will emerge in the open, self-standing position shown in FIG. 10. Thus, self-standing container 10 is easily and quickly dispensed, opened, and filled. The novel dispensing method saves effort and time, particularly when performing multiple manual filling operations.

As a result of the above discussion, it should be seen that the self-standing container of the present invention can be easily adapted into the folded position and then instantly adapted into the self-standing position with a minimum of time and effort, and once opened will remain open and standing on its own, even when made of flexible, vinyl plastic. The self-standing container can be sealed and reused, making it an excellent replacement for sandwich bags and other such plastic bags. The present invention overcomes the problems in the art of stackability, due to its square shape when in the self-standing position. This also makes the self-standing container of the present invention suitable for microwave use. It is well suited for containing liquids, particularly when formed with an integral top. The ease of dispensing of the self-standing container of the present invention makes it highly desirable for repeated manual fillings. The self-standing container is easily filled without requiring a frame to hold the self-standing container, even when made of highly flexible plastic. The accompanying method of manufacture makes the self-standing container easily and inexpensively manufacturable.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A compactly storable, self-standing container comprising:

a. a plurality of side sections;

b. a lid attached to at least one side section;

c. a bottom section attached to the side sections;

d. an interior located between the four side sections and the bottom section, the container having a folded position and a separate self-standing position and at least a substantial portion of the container being made of flexible, supple plastic; and e. a zipper-type closure device on at least one edge of the lid, whereby the lid is sealable to at least one of the side sections with the zipper-type closure device to thereby form a substantially air-tight seal around the interior of the container.

2. A container as recited in claim 1, wherein the zipper-type closure device comprises a bead and a groove.

3. A container as recited in claim 2, wherein, said groove is located on one of the lid and at the plurality of side sections and the bead is located on the other of the lid and the plurality of side sections, the groove making a removable and conformable fit around the bead, whereby said bead and said groove accomplish an air-tight closure of the bead and groove closure device.

4. A container as recited in claim 1, wherein one of the bead and the groove of the bead and groove closure device is located within an integral three sided insert, the three-sided insert being attached to three side sections of said plurality of side sections, and extending laterally outward from each of the three side sections of said plurality of side sections when the container is in the self-standing position.

5. A compactly storable, self-standing container comprising:

a. a plurality of side sections;

b. a bottom section attached to the side sections;

c. folds for adapting the container into a folded position and allowing a separate self-standing position, the container being substantially flat with two of the side sections exposed when in the folded position and being converted from the folded position to the self-standing position by a force applied in an opposite direction to each of the two exposed side sections, the plurality of side sections being substantially perpendicular to said bottom section when the container is in the self-standing position, and wherein at least a substantial portion of the container is made of vinyl plastic;

d. a lid attached to at least one side section;

e. an interior located between the plurality of side sections and the bottom section; and f. a zipper-type closure device on at least one edge of the lid, whereby the lid is sealable to at least one of the side sections with the zipper-type closure device to thereby form a substantially air-tight seal around the interior.

6. A container as recited in claim 5, wherein when in the folded position the container has an exposed surface area that is substantially the same as that of one of the exposed side sections.

7. A container as recited in claim 5, wherein the edges of the side sections are attached to form four corners, the side sections comprising a front and a rear side section and a right and a left side section, and wherein the folds for adapting the container into a folded position and allowing a separate upright self-standing position comprise a vertical fold line formed in approximately the center of each of the right and left side sections, the vertical fold lines extending for substantially the entirety of the right and left side sections, the folds for adapting the container into a folded position and allowing a separate upright self-standing position also comprising a longitudinal fold line extending through the center of the bottom section between the vertical fold lines of the right and left side sections, with four diagonal fold lines stemming from the longitudinal fold line and extending each toward a separate corner.

8. A container as recited in claim 7, further comprising an interior located between the plurality of side sections and the bottom section, and whereby when in the folded position the right and left side sections are folded over with the vertical fold lines being drawn into the interior and the diagonal fold lines of the bottom section being drawn upward into the interior, and with the horizontal fold line in the bottom section being hinged to form two equal segments and a center between the two segments, with the center being drawn upward into the interior and the two segments being substantially parallel to each other.

9. A container as recited in claim 8, wherein when in the folded position each of the two segments of the horizontal fold line is contiguous with a vertical fold line of the right and left side sections for substantially the entire length of the respective segment of the horizontal fold line, and wherein the container lies flat with the entirety of the front and rear side sections remaining exposed and in close proximity to each other over substantially their entire surface area, with the right and left side sections and the bottom section collapsed therebetween.

10. A container as recited in claim 9, wherein when in the folded position the bottom section is arranged in four layers and forms six geometrically shaped portions each having at least three sides.

11. A container as recited in claim 5, wherein the container is made from a single sheet of vinyl plastic, the single sheet of vinyl plastic being stamped into a desired shape, the desired shape including seam edges, with the seam edges being sealed together.

12. A container as recited in claim 5, wherein the zipper-type closure device comprises a bead and groove closure device having a bead and groove, said groove being located on one of the lid and at least one of the plurality of side sections, with the groove making a removable and resilient conformable fit around the bead which is located on one of the lid and at least one of the plurality of side sections, whereby said bead and said groove accomplish an air-tight closure of the bead and groove closure device.

13. A container as recited in claim 12, wherein one of the bead and the groove of the bead and groove closure device is located within an integral three sided insert, the three-sided insert being attached to three side sections of said plurality of side sections, and extending laterally outward from each of the three side sections of said plurality of side sections when the container is in the self-standing position.

14. A container as recited in claim 5, wherein the lid is integrally attached to one of the plurality of side sections, the lid having a horizontally extending fold line formed therein with which the lid is foldable into two halves, each of the two halves being of approximately the same dimensions said one of the plurality of side sections, and wherein the container when in the folded position thereof has substantially the same dimensions as said one of the plurality of side sections.

15. A compactly storable, self-standing container comprising:

a. a front and a rear side section, b. a right and a left side section, the right and left side sections each having a vertical fold line extending through approximately the center of the side section thereof, the front and rear and right and left side sections being attached together at the edges to form four corners;

c. a bottom section attached to each of the four side sections and having a longitudinal fold line through the center thereof extending between the vertical fold lines of the right and left side sections, and also having four diagonal fold lines originating at the longitudinal fold line and extending each to a separate corner;

d. an interior formed between the front and rear and right and left side sections and the bottom section, the container having a folded position thereof and an upright, self-standing position thereof, the folded position having the right and left side sections folded over with the vertical fold lines being drawn into the interior and the longitudinal fold line being divided into at least two segments having a center between the two segments, with the center being raised upward and the two segments being drawn inward toward the interior, becoming contiguous with each other and contiguous with the vertical fold lines of the right and left side sections, with the bottom section being formed into six portions arranged into four layers, and such that the container is flat with the entirety of the front and rear side sections exposed and in close proximity to each other over substantially their entire surface area and having the right and left side sections and the bottom section collapsed between them, the self-standing position of the container being assumed from the folded position thereof by exerting an opposing force on each of the front and rear side-sections, and wherein at least a substantial portion of the container is made of vinyl plastic;

e. a lid attached to at least one of the plurality of side sections, the lid being provided with a zipper-type closure device on at least one edge thereof and being sealable to said at least one of the plurality of side sections to form a substantially air-tight seal around the interior of the container.

16. A container as recited in claim 15, wherein the container is made from a single sheet of vinyl plastic, the single sheet of vinyl plastic being stamped into a desired shape, the desired shape including seam edges, with the seam edges being sealed together.

17. A container as recited in claim 15, wherein the zipper-type closure device comprises a bead and groove closure device having a groove located on one of the lid and at least one of the plurality of side sections, the groove making a removable and resilient conformable fit around a bead located on the other of the lid and at least one of the plurality of side sections to accomplish a substantially air-tight seal around the interior of the container.

18. A container as recited in claim 17, wherein one of the bead and the groove of the bead and groove closure device is located on an integral three sided insert, the three-sided insert being attached to three side sections of said plurality of side sections, and extending laterally outward from each of the three side sections of said plurality of side sections when the container is in the self-standing position.

19. A container as recited in claim 15, wherein the lid is integrally attached to one of the plurality of side sections, the lid having a horizontally extending fold line formed therein with which the lid is foldable into two halves, each of the two halves being of approximately the same dimensions as said one of the plurality of side sections, whereby the container when in the folded position thereof has substantially the same dimensions as said one of the plurality of side sections.

* * * * *